United States Patent [19]

Demura et al.

[11] Patent Number: 4,881,368

[45] Date of Patent: Nov. 21, 1989

[54] DOUBLE AIR-FUEL RATIO SENSOR SYSTEM HAVING IMPROVED EXHAUST EMISSION CHARACTERISTICS

[75] Inventors: Takayuki Demura, Mishima; Kohei Igarashi, Susono, both of Japan

[73] Assignee: Toyota Jidosha Kabushiki Kaisha, Japan

[21] Appl. No.: 152,928

[22] Filed: Feb. 5, 1988

[30] Foreign Application Priority Data

Feb. 9, 1987 [JP] Japan ..... 62-026339
Mar. 6, 1987 [JP] Japan ..... 62-050324

[51] Int. Cl.[4] ..... F02D 41/14; F01N 3/20

[52] U.S. Cl. ..... 60/274; 60/276; 60/285; 123/489

[58] Field of Search ..... 123/440, 489, 589; 60/274, 276, 285; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,712,373 | 12/1987 | Nagai et al. | 60/276 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72646 | 4/1983 | Japan . |
| 58-72647 | 4/1983 | Japan . |
| 58-135343 | 8/1983 | Japan . |
| 58-150038 | 9/1983 | Japan . |
| 58-150039 | 9/1983 | Japan . |
| 58-152147 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Oliff & Berridge

[57] ABSTRACT

In a double air-fuel sensor system including two air-fuel ratio sensors upstream and downstream of a catalyst converter provided in an exhaust gas passage, an air-fuel ratio correction amount is calculated in accordance with the outputs of the upstream-side and downstream-side air-fuel ratio sensors, thereby obtaining an actual air-fuel ratio. When all of the feedback control conditions for the downstream-side air-fuel ratio sensor are satisfied, a speed of renewal of the air-fuel ratio correction amount in accordance with the output of the downstream-side air-fuel ratio sensor is lowered before the output of the downstream-side air-fuel ratio sensor is reversed or for a predetermined time period.

86 Claims, 41 Drawing Sheets

| Fig. 5A | Fig. 5 B | Fig. 5C |
|---|---|---|

LEAN
RICH
A/F
TDR
CDLY 0
t1
t2
t3
t4
t5
t6
t7
t8
TDL
A/F'
(F1)

TDR
(-TDL)
LEAN
RICH
TDR

KIR
FAF1
RSL
RSR
KIL

| Fig. 7A | Fig. 7B | Fig. 7C |
|---|---|---|

$KI2_1 < KI2_2$

| Fig.10A | Fig.10B | Fig.10C |
|---|---|---|

| Fig.13 A | Fig.13 B | Fig.13 C |
|---|---|---|

$KI2_1 < KI2_2$

| Fig. 15A | Fig. 15B | Fig. 15C |
|---|---|---|

| Fig.17A | Fig.17B | Fig.17C |
|---|---|---|

| Fig. 19A | Fig. 19B | Fig. 19C |
|---|---|---|

| Fig. 21 A | Fig. 21 B | Fig. 21 C |
|---|---|---|

| Fig.23A | Fig.23B | Fig.23C |
|---|---|---|

DOUBLE AIR-FUEL RATIO SENSOR SYSTEM HAVING IMPROVED EXHAUST EMISSION CHARACTERISTICS

BACKGROUND OF THE INVENTION (1) Field of the Invention

The present invention relates to a method and apparatus for feedback control of an air-fuel ratio in an internal combustion engine having two air-fuel ratio sensors upstream and downstream of a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, for example, an air-fuel ratio feedback control parameter such as a rich skip amount RSR and/or a lean skip amount RSL is calculated in accordance with the output of the downstream-side $O_2$ sensor, and an air-fuel ratio correction amount FAF is calculated in accordance with the output $V_1$ of the upstream-side $O_2$ sensor and the air-fuel ratio feedback control parameter (see: U.S. Pat. No. 4,693,076). In this case, the air-fuel ratio feedback control parameter is stored in a backup random access memory (RAM). Therefore, when the downstream-side $O_2$ sensor is brought to a non-activation state or the like to stop the calculation of the air-fuel ratio feedback control parameter by the downstream-side $O_2$ sensor, the air-fuel ratio correction amount FAF is calculated in accordance with the output of the upstream-side $O_2$ sensor and the air-fuel ratio feedback control parameter which was calculated in an activation state of the downstream-side $O_2$ sensor (i.e., an air-fuel ratio feedback control mode for the downstream-side $O_2$ sensor) and was stored in the backup RAM.

In the above-mentioned double $O_2$ sensor system, however, since the open-loop control conditions for the downstream-side $O_2$ sensor are such that the coolant temperature is lower than a predetermined temperature; the engine is in an idling state; the engine is in a fuel cut-off state; the output of the downstream-side $O_2$ sensor is not once changed from the lean side to the rich side, or vice versa, and the like, the downstream-side $O_2$ sensor is still partially in a non-activation state even when the control is transferred from an air-fuel ratio feedback control mode for the downstream-side $O_2$ sensor. Also, in this case, the downstream-side $O_2$ sensor is greatly affected by the $O_2$ storage effect of the catalyst converter, and therefore, a large delay may occur in the switching of the output of the downstream-side $O_2$ sensor from the lean side to the rich side. Also, such a delay may be due to the characteristics of the parts of the downstream-side $O_2$ sensor, individual changes due to the aging of these parts, environmental changes, and the like. As a result, even when the control is transferred from an open-loop control mode for the downstream-side $O_2$ sensor to an air-fuel ratio feedback control mode for the downstream-side $O_2$ sensor, the output of the downstream-side $O_2$ sensor indicates a lean state for a long time, and thus the air-fuel ratio feedback control parameter may be so large or small that an air-fuel ratio feedback control by the upstream-side $O_2$ sensor using the air-fuel ratio feedback control parameter produces an overrich air-fuel ratio, thus increasing the HC and CO emissions, and raising the fuel consumption.

SUMMARY OF THE INVENTION

It is an object of the present invention to provide a double air-fuel ratio sensor system having improved exhaust emission and fuel consumption characteristics immediately after the control is transferred from an open-loop control mode for a downstream-side air-fuel ratio sensor to an air-fuel ratio feedback control mode for the downstream-side air-fuel ratio sensor.

According to the present invention, when all of the feedback control conditions for the downstream-side air-fuel ratio sensor are satisfied, a speed of renewal of the air-fuel ratio correction amount in accordance with the output of the downstream-side air-fuel ratio sensor is lowered before the output of the downstream-side air-fuel ratio sensor is reversed or for a predetermined time period. Therefore, even when the switching of the downstream-side air-fuel ratio sensor from the lean side to the the rich side or vice versa is slow, an overcorrection of an air-fuel ratio feedback amount such as an air-fuel ratio feedback parameter is avoided, thus improving the exhaust emission and fuel consumption characteristics.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
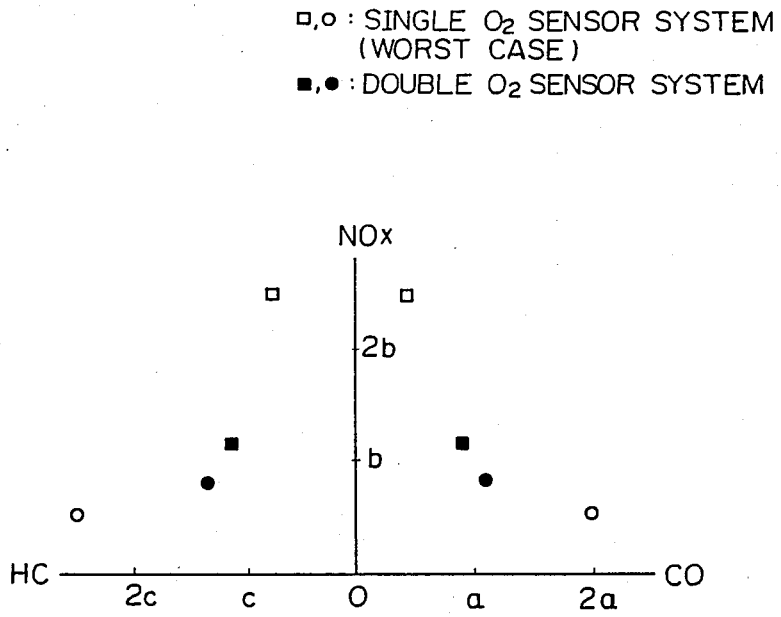
FIG. 1 is a graph showing the emission characteristics of a single $O_2$ sensor system and a double $O_2$ sensor system.
Figure 2:
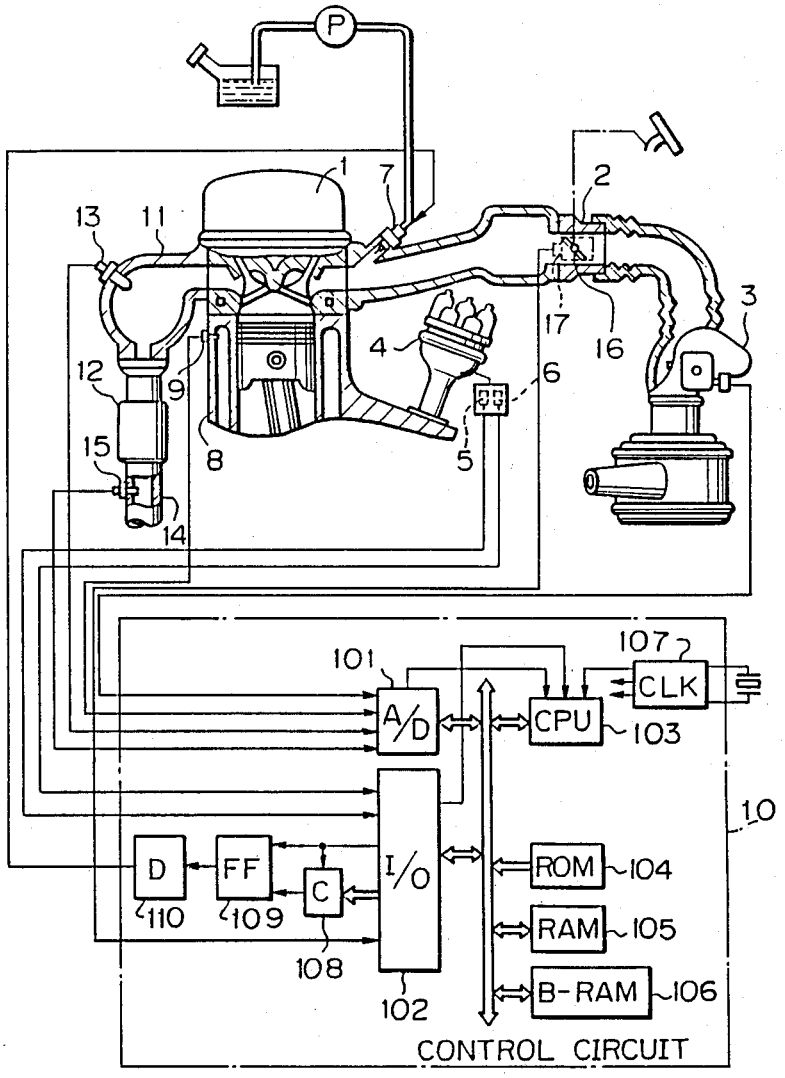
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank angle sensor 5 generates a pulse signal at every 720° crank angle (CA) and the crank-angle sensor 6 generates a pulse signal at every 30° CA. The pulse signals of the crank angle sensors 5 and 6 are supplied to an input/output (I/0) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit those signals to the A/D converter 101 of the control circuit 10.

Reference 16 designates a throttle valve, and 17 an idle switch for detecting whether or not the throttle valve 16 is completely closed.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned OFF.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 013 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i,e., at every pulse signal of the crank angle sensor 6, and is then stored in the RAM 105.

Figure 3:
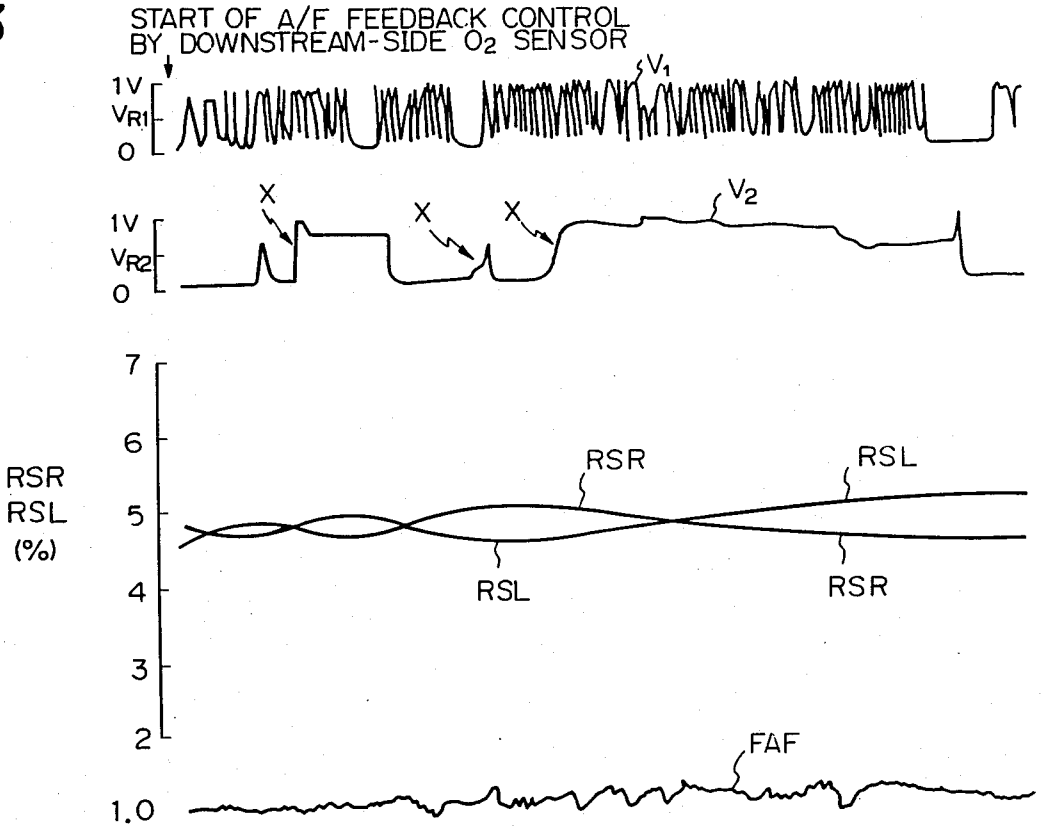
Fig. 3 PRIOR ART
FIGS. 3 and 4 are timing diagrams showing examples of an air-fuel ratio feedback parameter in the prior art.
Figure 4:
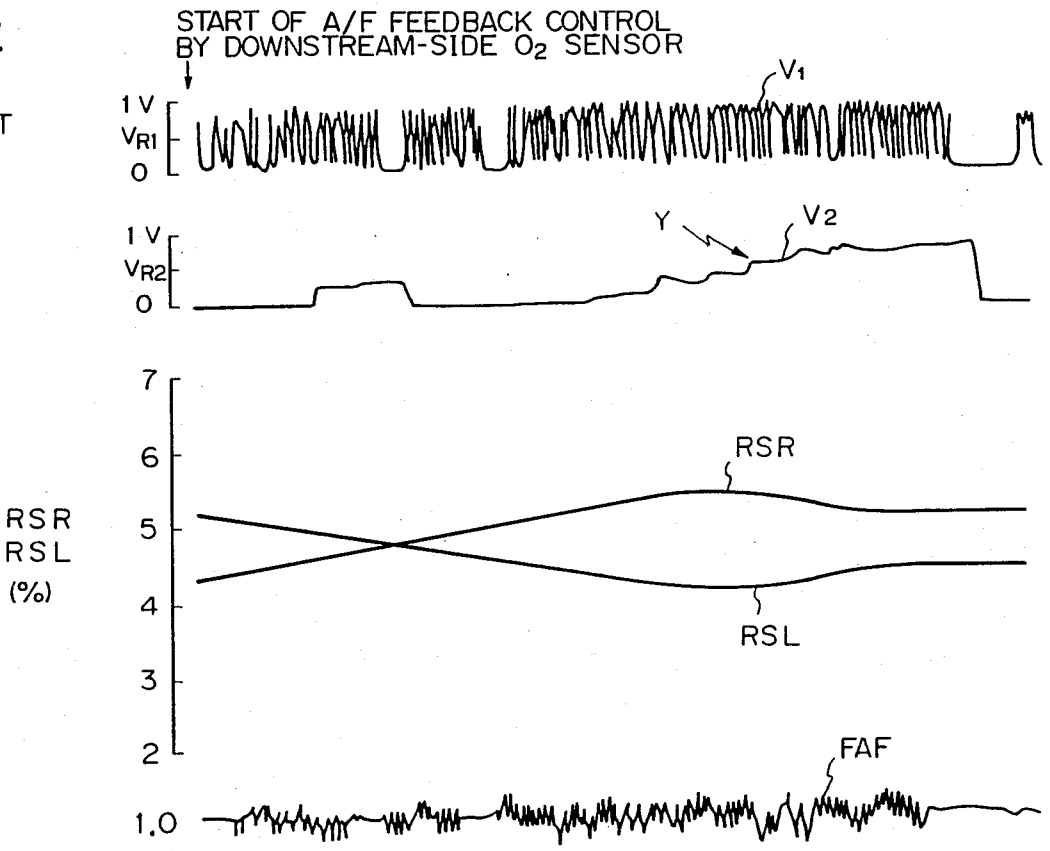
Fig. 4 PRIOR ART

First, a rich skip amount RSR and a lean skip amount RSL as the air-fuel ratio feedback control parameter will be explained with reference to FIGS. 3 and 4. In FIGS. 3 and 4, reference $V_1$ designates an output of the upstream-side $O_2$ sensor 13, and $V_2$ designates an output of the downstream-side $O_2$ sensor 15. The rich skip amount RSR and the lean skip amount RSL are calculated in accordance with the result of a comparison of the output $V_2$ of the downstream-side $O_2$ sensor 15 with a reference voltage $V_{R2}$, and an air-fuel ratio correction amount FAF is calculated in accordance with the result of a comparison of the output $V_1$ of the upstream-side $O_2$ sensor 13 with a reference voltage $V_{R1}$ and the skip amounts RSR and RSL.

In FIG. 3, which shows a case where the switching of the output $V_2$ of the downstream-side $O_2$ sensor 15 from the lean side to the rich side is relatively rapid, the output $V_2$ of the downstream-side $O_2$ sensor 15 is changed as indicated by arrows X after the control enters an air-fuel ratio feedback control mode for the downstream-side $O_2$ sensor 15. In this case, the rich skip amount RSR and the lean skip amount RSL are at an appropriate level, and therefore, the air-fuel ratio correction amount FAF is close to a level corresponding to the stoichiometric air-fuel ratio.

Contrary to the above, in FIG. 4, which shows a case where the output $V_2$ of the downstream-side $O_2$ sensor 15 from the lean side to the rich side is relatively slow, the output $V_2$ of the downstream-side $O_2$ sensor 15 is changed as indicated by an arrow Y, and as a result, the skip amounts RSR and RSL are overcorrected to the rich side. Accordingly, the air-fuel ratio correction amount FAF is deviated from the stoichiometric level to the rich side.

According to the present invention, in FIG. 4, when the output $V_2$ of the downstream-side $O_2$ sensor 15 is changed slowly, the overcorrection of the air-fuel ratio correction amount FAF is avoided by lowering a speed of renewal of the skip amounts RSR and RSL before a reversion occurs in the output $V_2$ of the downstream-side $O_2$ sensor 15.

The operation of the control circuit 10 of FIG. 2 will be now explained.

Figures 5, 5A:
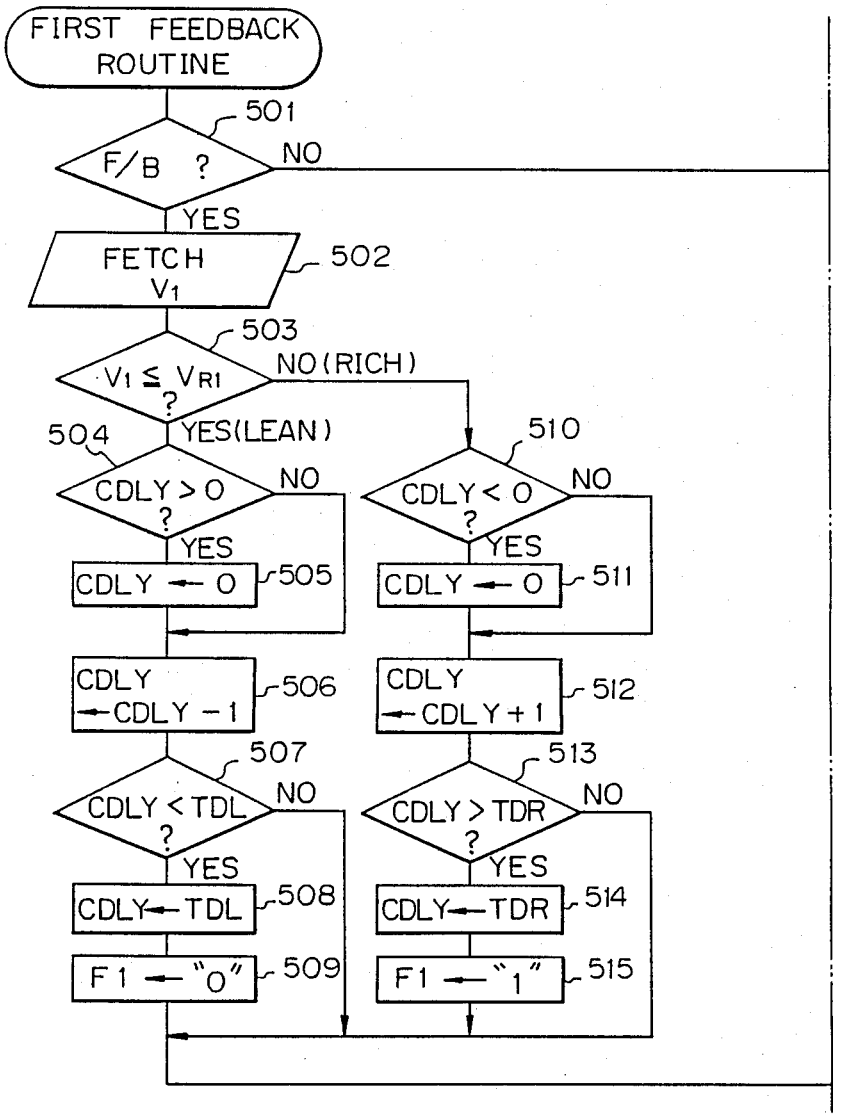
FIGS. 5, 5A–5C, 7, 7A–7C, 9, 10, 10A–10C, 12, 13, 13A–13C, 15, 15A–15C, 17, 17A–17C, and 19, 19A–19C, 21, 21A–21C, 22, 23 and 23A–23C are flow charts showing the operation of the control circuit of FIG. 2.
Figure 5B:
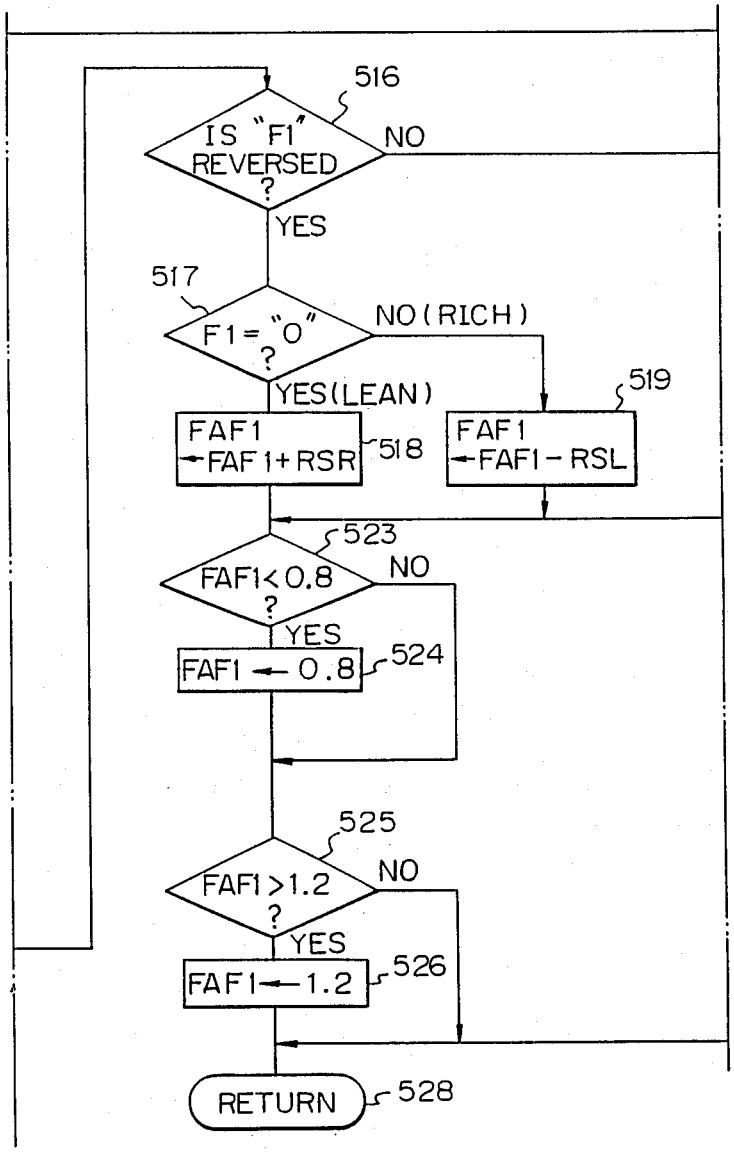
Figure 5C:
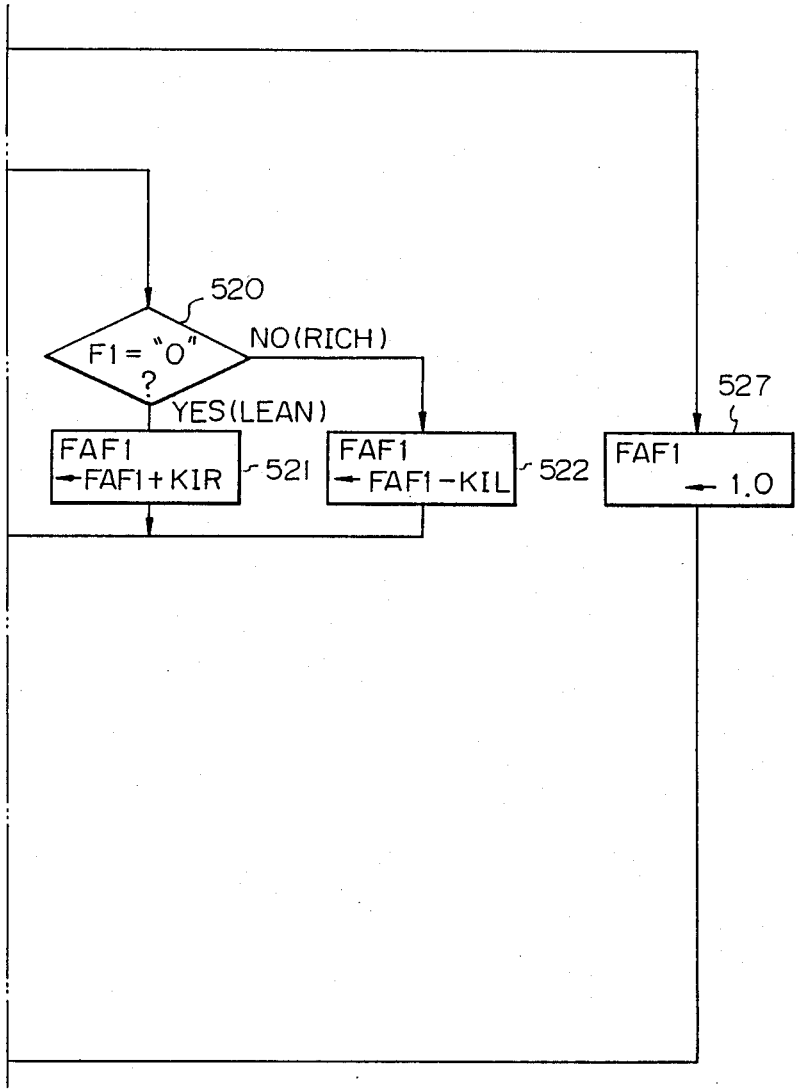

FIG. 5 is a routine for calculating a first air-fuel ratio feedback correction amount FAF1 in accordance with output of the upstream-side $O_2$ sensor 13 executed at every predetermined time period such as 4 ms.

At step 501, it is determined whether or not all of the feedback control (closed-loop control) conditions by the upstream-side $O_2$ sensor 13 are satisfied. The feedback control conditions are as follows:

(i) the engine is not in a starting state;
(ii) the coolant temperature THW is higher than 50° C.;
(iii) the power fuel incremental amount FPOWER is 0; and
(iv) the upstream-side $O_2$ sensor 13 is in an activated state.

Note that the determination of activation/non-activation of the upstream-side $O_2$ sensor 13 is carried out by determining whether or not the coolant temperature THW≧70° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one of more of the feedback control conditions is not satisfied, the control proceeds to step 527, in which the amount FAF1 is caused to be 1.0 (FAF1=1.0), thereby carrying out an open-loop control operation. Note that, in this case, the amount FAF1 can be a value of a mean value immediately before the open-loop control operation. That is, the amount FAF1 or a mean value FAFI thereof is stored in the backup RAM 106, and in an open-loop control operation, the value FAF1 or FAFI is read out of the backup RAM 106.

Contrary to the above, at step 501, if all of the feedback control conditions are satisfied, the control proceeds to step 502.

At step 502, an A/D conversion is performed upon the output voltage $V_1$ of the upstream-side $O_2$ sensor 13, and the A/D converted value thereof is then fetched from the A/D converter 101. Then at step 503, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 504, which determines whether or not the value of a delay counter CDLY is positive. If CDLY>0, the control proceeds to step 505, which clears the delay counter CDLY, and then proceeds to step 506. If CDLY≦0, the control proceeds directly to step 506. At step 506, the delay counter CDLY is counted down by 1, and at step 507, it is determined whether or not CDLY ° TDL. Note that TDL is a lean delay time period for which a rich state is maintained even after the output of the upstream-side $O_2$ sensor 13 is changed from the rich side to the lean side, and is defined by a negative value. Therefore, at step 507, only when CDLY ° TDL does the control proceed to step 508, which causes CDLY to be TDL, and then to step 509, which causes a first air-fuel ratio flag F1 to be "0" (lean state). On the other hand, if $V_1 > V_{R1}$, which means that the current air-fuel ratio is rich, the control proceeds to step 510, which determines whether or not the value of the delay counter CDLY is negative. If CDLY<0, the control proceeds to step 511, which clears the delay counter CDLY, and then proceeds to step 512. If CDLY >0, the control directly proceeds to 512. At step 512, the delay counter CDLY is counted up by 1, and at step 513, it is determined whether or not CDLY>TDR. Note that TDR is a rich delay time period for which a lean state is maintained even after the output of the upstream-side $O_2$ sensor 13 is changed from the lean side to the rich side, and is defined by a positive value. Therefore, at step 513, only when CDLY>TDR does the control proceed to step 514, which causes CDLY to TDR, and then to step 515, which causes the first air-fuel ratio flag Fl to be "1" (rich state).

Next, at step 516, it is determined whether or not the first air-fuel ratio flag F1 is reversed, i.e., whether or not the delayed air-fuel ratio detected by the upstream-side $O_2$ sensor 13 is reversed. If the first air-fuel ratio flag Fl is reversed, the control proceeds to steps 517 to 519, which carry out a skip operation.

At step 517, if the flag F1 is "0" (lean), the control proceeds to step 518, which remarkably increases the correction amount FAF1 by a skip amount RSR. Also, if the flag F1 is "1" (rich) at step 517, the control proceeds to step 519, which remarkably decreases the correction amount FAF1 by a skip amount RSL.

On the other hand, if the first air-fuel ratio flag F1 is not reversed at step 516, the control proceeds to steps 520 to 522, which carries out an integration operation. That is, if the flag F1 is "0" (lean) at step 520, the control proceeds to step 521, which gradually increases the correction amount FAF1 by a rich integration amount KIR. Also, if the flag F1 is "1" (rich) at step 520, the control proceeds to step 522, which gradually decreases the correction amount FAF1 by a lean integration amount KIL.

The correction amount FAF1 is guarded by a minimum value 0.8 at steps 523 and 524. Also, the correction amount FAF1 is guarded by a maximum value 1.2 at steps 525 and 526. Thus, the controlled air-fuel ratio is prevented from becoming overlean or overrich.

The correction amount FAF1 is then stored in the RAM 105, thus completing this routine of FIG. 5 at steps 528.

Figures 6A, 6B, 6C, 6D:
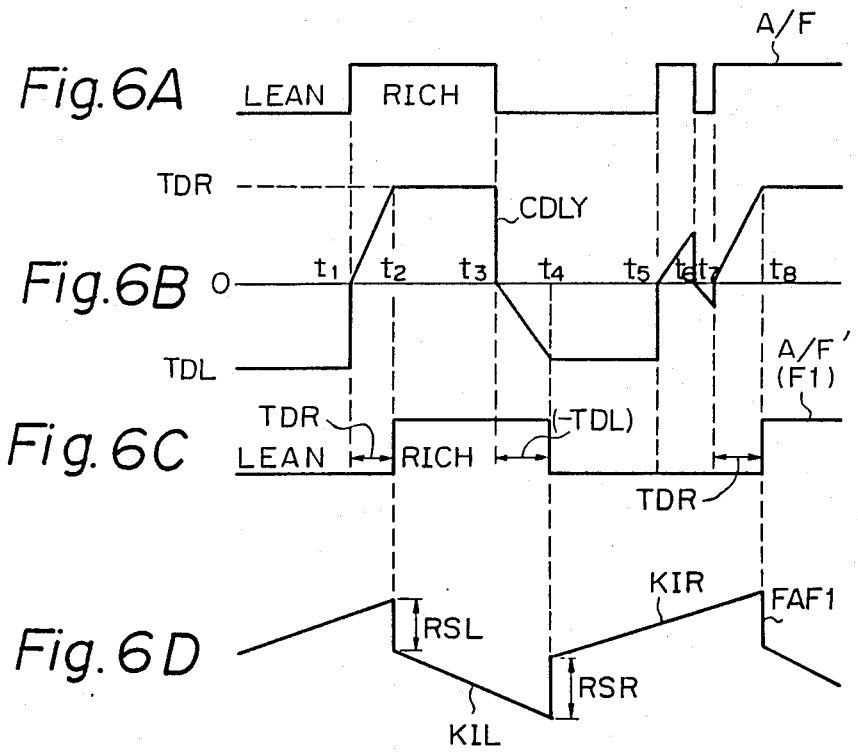
FIGS. 6A through 6D are timing diagrams explaining the flow chart of FIG. 5.

The operation by the flow chart of FIG. 5 will be further explained with reference to FIGS. 6A through 6D. As illustrated in FIG. 6A, when the air-fuel ratio A/F is obtained by the output of the upstream-side $O_2$ sensor 13, the delay counter CDLY is counted up during a rich state, and is counted down during a lean state, as illustrated in FIG. 6B. As a result, a delayed air-fuel ratio corresponding to the first air-fuel ratio flag F1 is obtained as illustrated in FIG. 6C. For example, at time t, even when the air-fuel ratio A/F is changed from the lean side to the rich side, the delayed air-fuel ratio A/F' (F1) is changed at time $t_2$ after the rich delay time period TDR. Similarly, at time $t_3$, even when the air-fuel ratio A/F is changed from the rich side to the lean side, the delayed air-fuel ratio F1 is changed at time $t_4$ after the lean delay time period TDL. However, at time $t_5$, $t_6$, or $t_7$, when the air-fuel ratio A/F is reversed within a shorter time period than the rich delay time period TDR or the lean delay time period TDL, the delay air-fuel ratio A/F' is reversed at time $t_8$. That is, the delayed air-fuel ratio A/F' is stable when compared with the air-fuel ratio A/F. Further, as illustrated in FIG. 6D, at every change of the delayed air-fuel ratio A/F' from the rich side to the lean side, or vice versa, the correction amount FAF is skipped by the skip amount RSR or RSL, and in addition, the correction amount FAF1 is gradually increased or decreased in accordance with the delayed air-fuel ratio A/F'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side 0 sensor 13 is variable. Further, as the air-fuel ratio feedback control parameter, there are nominated a delay time period TD (in more detail, the rich delay time period TDR and the lean delay time period TDL), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich delay time period becomes longer than the lean delay time period (TDR>(−TDL)), the controlled air-fuel becomes richer, and if the lean delay time period becomes longer than the rich delay time period ((−TDL)>TDR), the controlled air-fuel ratio becomes leaner. Thus, the air-fuel ratio can be controlled by changing the rich delay time period TDR1 and the lean delay time period (−TDL) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output downstream-side $O_2$ sensor. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

There are various merits in the control of the air-fuel ratio feedback control parameters by the output $V_2$ of the downstream-side $O_2$ sensor 15. For example, when the delay time periods TDR and TDL are controlled by the output $V_2$ of the downstream-side $O_2$ sensor 15, it is possible to precisely control the air-fuel ratio. Also, when the skip amounts RSR and RSL are controlled by the output $V_2$ of the downstream-side $O_2$ sensor 15, it is possible to improve the response speed of the air-fuel ratio feedback control by the output $V_2$ of the downstream-side $O_2$ sensor 15. Of course, it is possible to simultaneously control two or more kinds of the air-fuel ratio feedback control parameters by the output $V_2$ of the downstream-side $O_2$ sensor 15.

A double $O_2$ sensor system into which a second air-fuel ratio correction amount FAF2 is introduced will be explained with reference to FIGS. 7 and 9.

Figures 7, 7A:
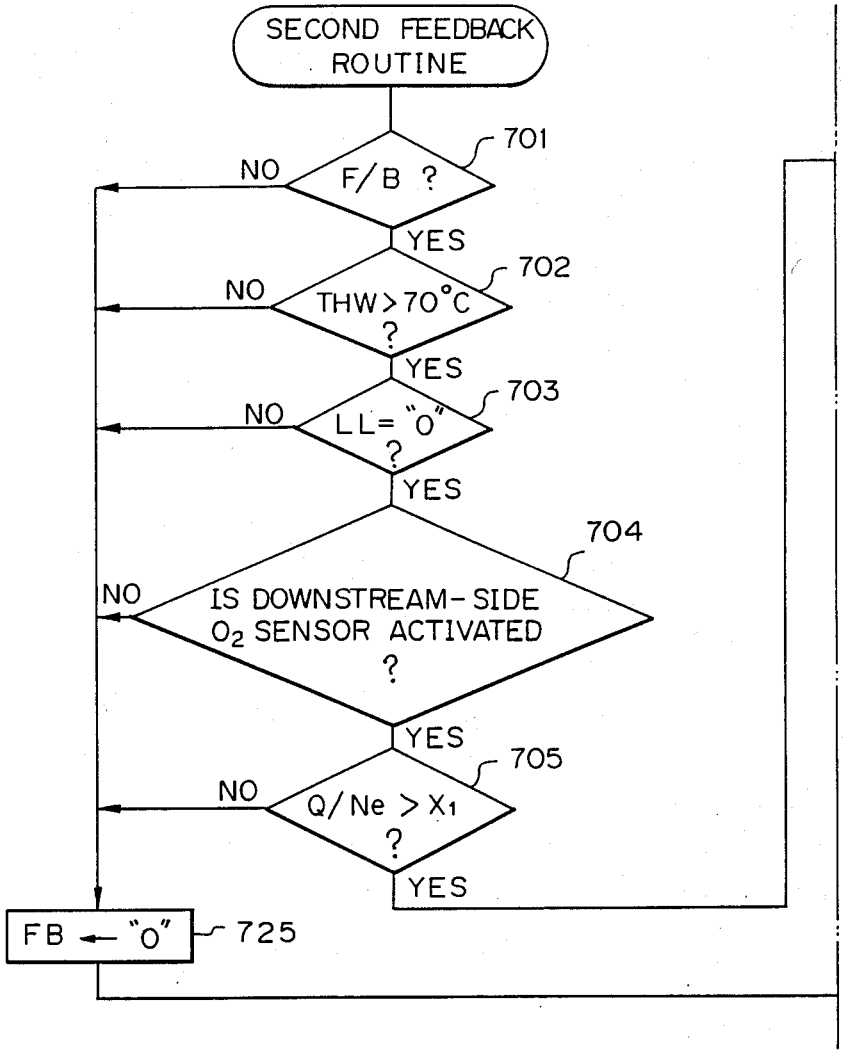
Figure 7B:
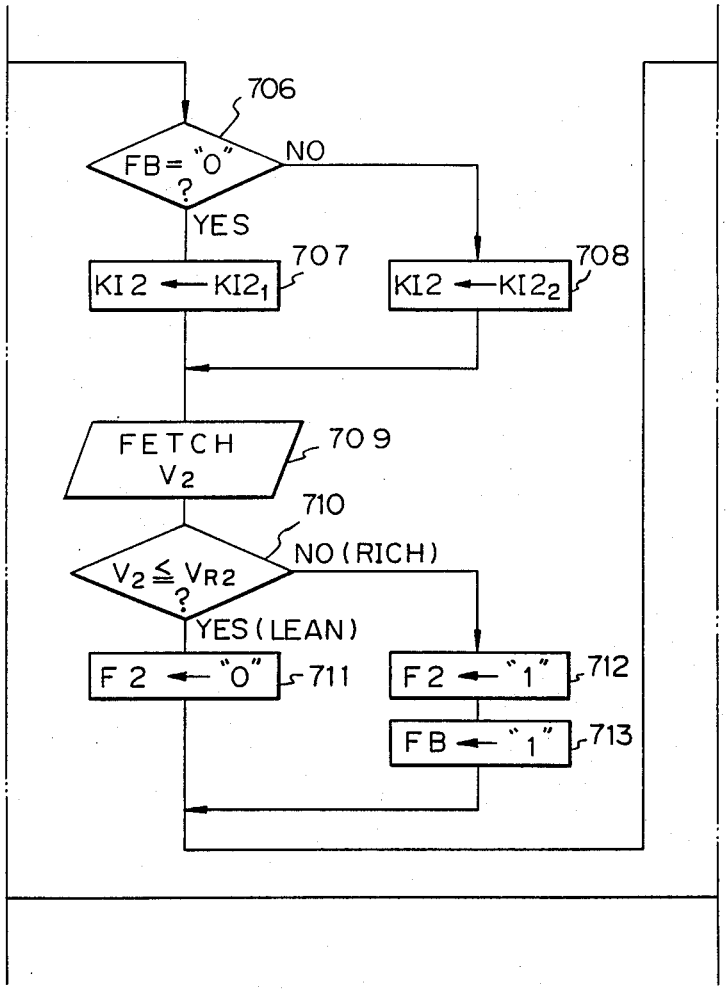
Figure 7C:
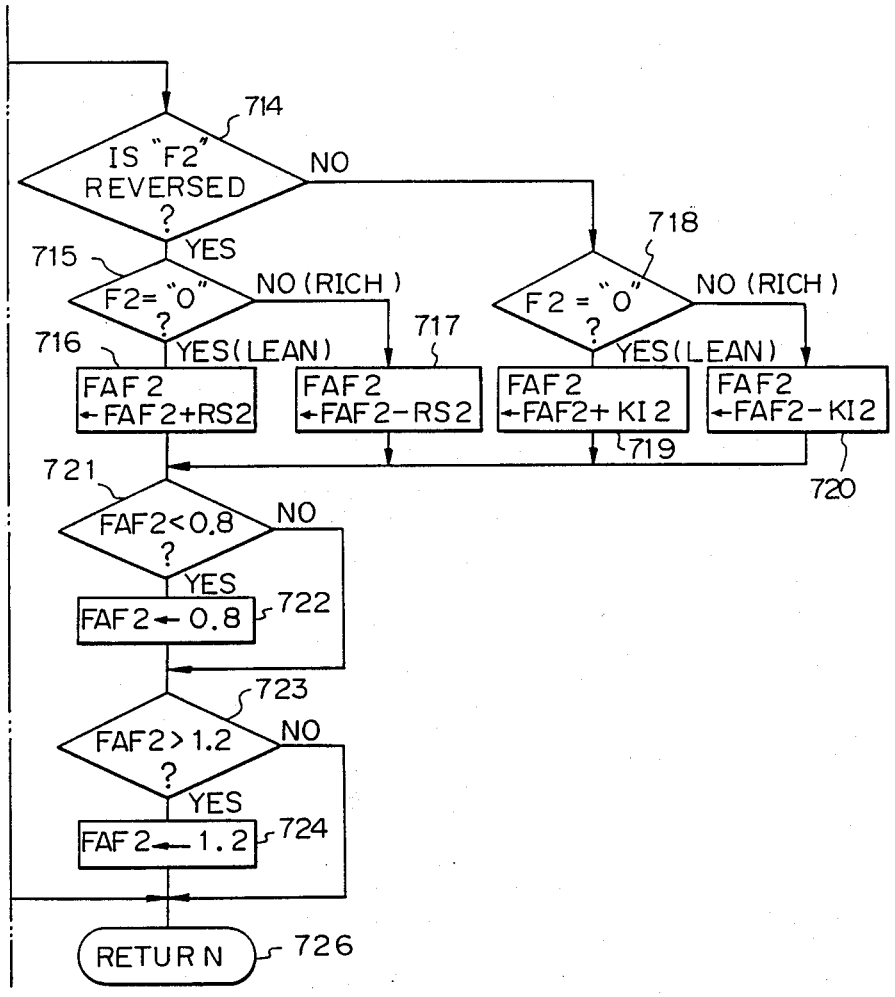

FIG. 7 is a routine for calculating a second air-fuel ratio feedback correction amount FAF2 in accordance with the output of the downstream-side $O_2$ sensor 15 executed at every predetermined time period such as 1 s.

At steps 701 through 705, it is determined whether or not all of the feedback control (closed-loop control) conditions by the downstream-side $O_2$ sensor 15 are satisfied. For example, at step 701, it is determined whether or not the feedback control conditions by the upstream-side $O_2$ sensor 13 are satisfied. At step 702, it is determined whether or not the coolant temperature THW is higher than 70° C. At step 703, it is determined whether or not the throttle valve 16 is open (LL="0"). At step 704, it is determined whether or not the output $V_2$ of the downstream-side $O_2$ sensor 15 has been once changed from the lean side to the rich side or vice versa. At step 705, it is determined whether or not a load parameter such as Q/Ne is larger than a predetermined value $X_1$. Of course, other feedback control conditions are introduced as occasion demands. However, an explanation of such other feedback control conditions is omitted.

If one or more of the feedback control conditions is not satisfied, the control proceeds via step 725 to step 726, thereby carrying out an open-loop control operation. At step 725, an air-fuel ratio reversion flag FB is reset. Note that, in this case, the amount FAF2 or a mean value FAF2 thereof is stored in the backup RAM 106, and in an open-loop control operation, the value FAF2 or FAF2 is read out of the backup RAM 106.

Contrary to the above, if all of the feedback control conditions are satisfied, the control proceeds to steps 706 through 724.

At steps 706, 707, and 708, a renewal speed of the second air-fuel ratio correction amount FAF2, which is, in this case, an integration amount KI2, is calculated. That is, at step 706, it is determined whether or not the air-fuel ratio reversion flag FB is "0". As a result, if FB="0", the control proceeds to step 707 which sets $KI2_1$ in the integration amount KI2, and if FB="1", the control proceeds to step 708 which sets $KI2_2$ in the integration amount KI2. Here, $KI2_1 < KI2_2$. Note that, at steps 707 and 708, the skip amounts RS2 can be changed instead of the integration amount KI2. In this case, at step 708, $$RS2 \leftarrow RS2_1$$

and at step 709, $$RS2 \leftarrow RS2_2 (> RS2_1).$$

Next, at step 709, an A/D conversion is performed upon the output voltage $V_2$ of the downstream-side $O_2$ sensor 15, and the A/D converted value thereof is then fetched from the A/D converter 101. Then, at step 710, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12. However, the voltage $V_{R2}$ can be voluntarily determined.

At step 710, if the air-fuel ratio upstream of the catalyst converter 12 is lean, the control proceeds to step 711 which resets a second air-fuel ratio flag F2. Alternatively, the control proceeds to the step 712, which sets the second air-fuel ratio flag F2, and then at step 713, the air-fuel ratio reversion flag FB is set.

That is, in FIG. 7, when the air-fuel ratio feedback control for the downstream-side $O_2$ sensor 15 is prohibited, it is assumed that the output $V_2$ of the downstream-side $O_2$ sensor 15 indicates a lean state. Thereafter, when the output $V_2$ of the downstream-side $O_2$ sensor 15 indicates a rich state after the control enters an air-fuel ratio feedback control mode for the downstream-side $O_2$ sensor 15, this means that a reversion has occurred on the output $V_2$ of the downstream-side $O_2$ sensor 15. Of course, the air-fuel ratio reversion flag FB can be set by determining whether or not the output of the downstream-side $O_2$ sensor 15 crosses a reference level such as the reference voltage $V_{R2}$.

Next, at step 714, it is determined whether or not the second air-fuel ratio flag F2 is reversed. If the second air-fuel ratio flag F2 is reversed, the control proceeds to steps 715 to 717 which carry out a skip operation. That is, if the flag F2 is "0" (lean) at step 715, the control proceeds to step 716, which remarkably increases the second correction amount FAF2 by a skip amount RS2. Also, if the flag F2 is "1" (rich) at step 715, the control proceeds to step 716, which remarkably decreases the second correction amount FAF2 by the skip amount RS2. On the other hand, if the second air-fuel ratio flag F2 is not reversed at step 714, the control proceeds to steps 718 to 720, which carry out an integration operation. That is, if the flag F2 is "0" (lean) at step 718, the control proceeds to step 719, which gradually increases the second correction amount FAF2 by an integration amount KI2. Also, if the flag F2 is "1" (rich) at step 719, the control proceeds to step 720, which gradually decreases the second correction amount FAF2 by the integration amount KI2.

Note that the skip amount RS2 is larger than the integration amount KI2.

The second correction amount FAF2 is guarded by a minimum value 0.8 at steps 721 and 722, and by a maximum value 1.2 at steps 723 and 724, thereby also preventing the controlled air-fuel ratio from becoming overrich or overlean.

The correction amount FAF2 is then stored in the backup RAM 106, thus completing this routine of FIG. 7 at step 726.

The routine of FIG. 7 will be further explained with reference to FIG. 8.

At time $t_1$, when an air-fuel ratio feedback control for the downstream-side $O_2$ sensor 15 is initiated, the control at step 706 proceeds to step 707, at which the integration amount KI2 is decreased by $KI2 \leftarrow KI2_1$, since the air-fuel ratio reversion flag FB is "0".

In this state, the second air-fuel ratio correction amount FAF2 is slowly increased, thus suppressing any overrich state of the second air-fuel ratio correction amount FAF2.

Next, at time $t_2$, when the output $V_2$ of the downstream-side $O_2$ sensor 15 is switched from the lean side to the rich side, the control at step 706 proceeds to step 707, at which the integration amount KI2 is increased by $KI2 \leftarrow KI2_2$. As a result, the second air-fuel ratio correction amount FAF2 is greatly changed to the lean side. The air-fuel ratio reversion flag FB is also set by step 713.

Thereafter, since the air-fuel ratio reversion flag FB is "1", the second air-fuel ratio correction amount FAF2 is changed at a relatively high speed defined by the integration amount $KI2_2$.

Figure 8:
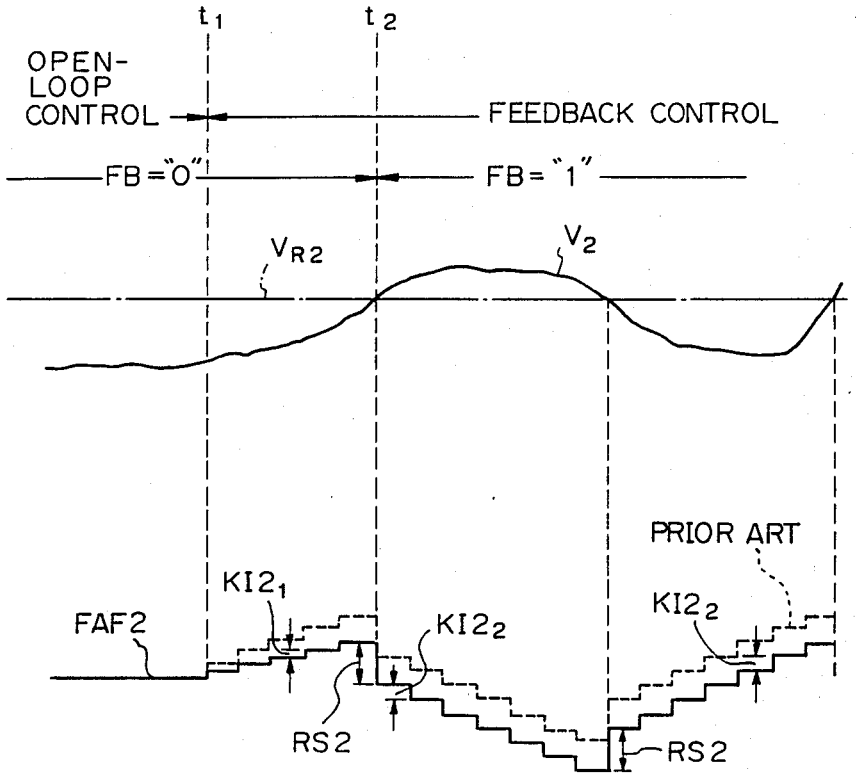
FIGS. 8, 11, 14, 16, 18, and 20 are timing diagrams explaining the flow charts of FIGS. 7, 10, 13, 15, 17, and 19, respectively.

Thus, according to the routine of FIG. 7, the second air-fuel ratio correction amount FAF2 is changed at a relatively low speed for a time period of from time $t_1$ to time $t_2$ of FIG. 8, and is changed at a relatively high speed after a time $t_2$ of FIG. 8.

Note that, if the second air-fuel ratio correction amount FAF2 is changed at a relatively high speed ($KI2=KI2_2$) even for a time period of from time $t_1$ to time $t_2$ as in the prior art, the second air-fuel ratio correction amount FAF2 becomes overrich as indicated by a dotted line in FIG. 8, and in addition, this overrich state remains for a long time, thus increasing the HC and CO emissions and the fuel consumption. Particularly, when the second air-fuel ratio correction amount FAF2 during an open-loop control mode is kept at a value immediately before the open-loop control mode, and in addition, a feedback control for the second air-fuel ratio correction amount FAF2 is started at such a value, the second air-fuel ratio correction amount FAF2 is diverged by frequent repetitions of the feedback control and the open-loop control. According to the present invention, the divergence of the second air-fuel ratio correction amount FAF2 is avoided.

Figure 9:
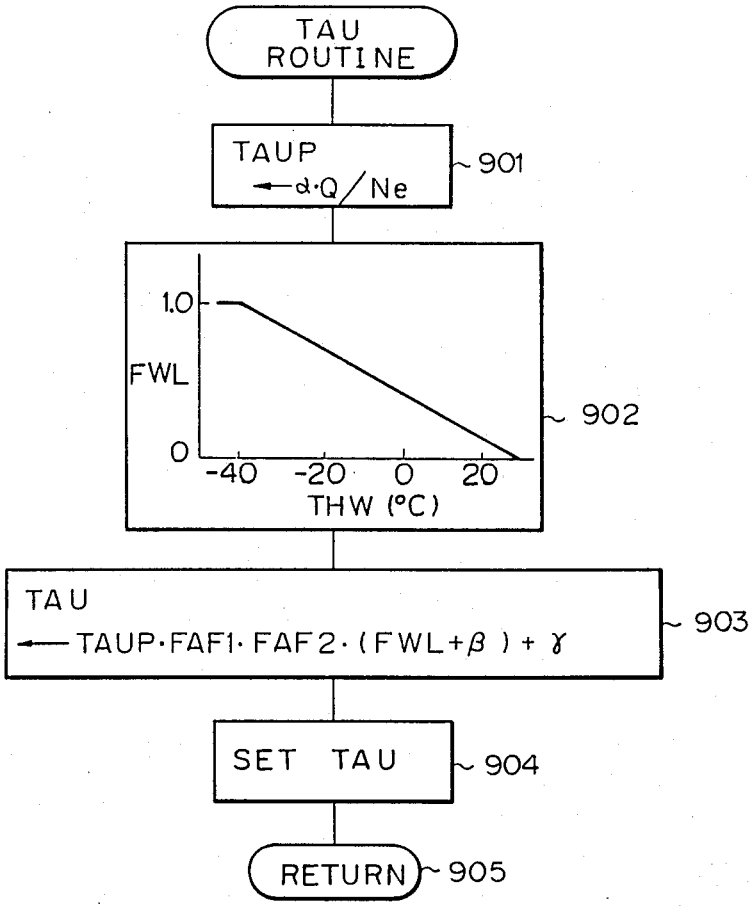

FIG. 9 is a routine for calculating a fuel injection amount TAU executed at every predetermined crank angle such as 360° CA. At step 901, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 902, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 903, a final fuel injection amount TAU is calculated by $$TAU \leftarrow TAUP \cdot FAF1 \cdot FAF2 \cdot (FWL+\beta)+\gamma$$

where $\beta$ and $\gamma$ are correction factors determined by other parameters such as the voltage of the battery and the temperature of the intake air. At step 904, the final fuel injection amount TAU is set in the down counter 107, and in addition, the flip-flop 108 is set to initiate the activation of the fuel injection valve 7. Then, this routine is completed by step 905. Note that, as explained above, when a time period corresponding to the amount TAU has passed, the flip-flop 109 is reset by the carry-out signal of the down counter 108 to stop the activation of the fuel injection valve 7.

A double $O_2$ sensor system, in which an air-fuel ratio feedback control parameter of the first air-fuel ratio feedback control by the upstream-side $O_2$ sensor is variable, will be explained with reference to FIGS. 10 and 12. In this case, the skip amounts RSR and RSL as the air-fuel ratio feedback control parameters are variable.

Figures 10, 10A:
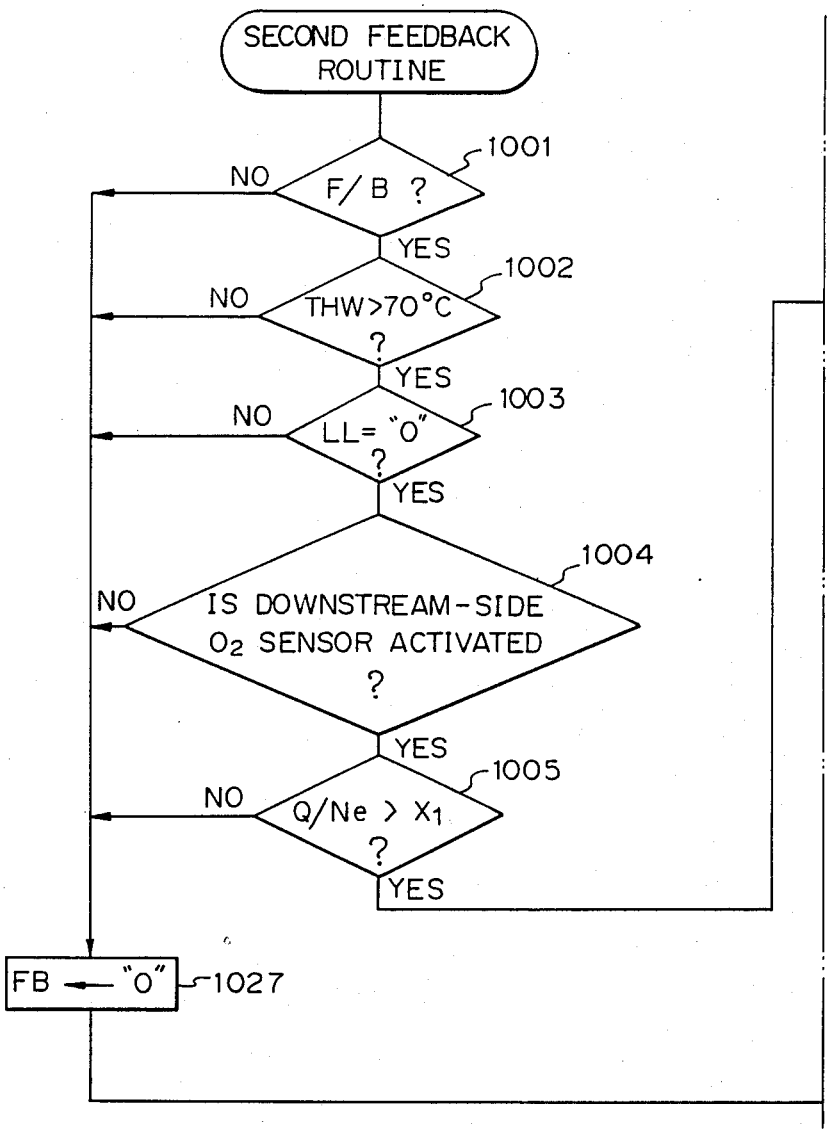
Figure 10B:
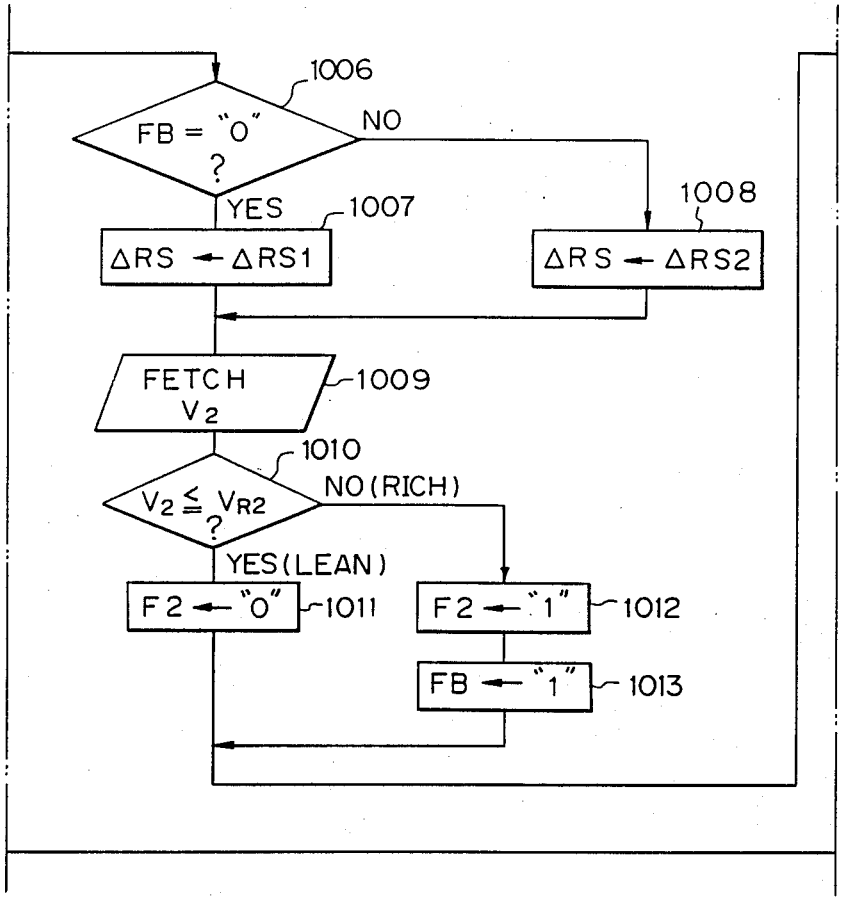
Figure 10C:
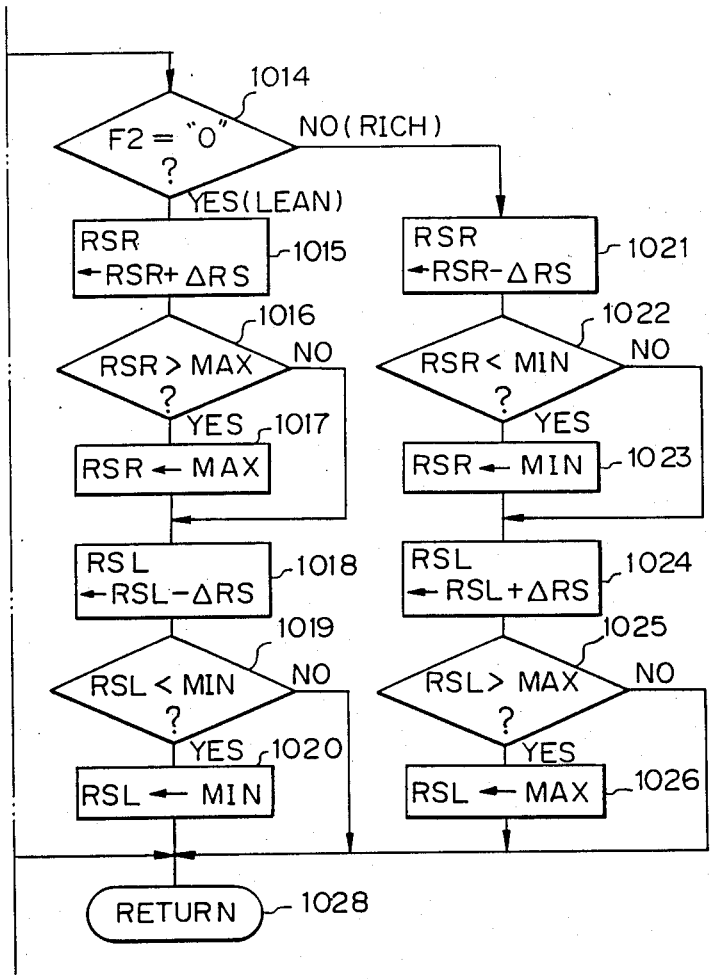

FIG. 10 is a routine for calculating the skip amounts RSR and RSL in accordance with the output of the downstream-side $O_2$ sensor 15 executed at every predetermined time period such as 1 s.

Steps 1001 through 1005 are the same as steps 701 through 705 of FIG. 7. That is, if one or more of the feedback control conditions is not satisfied, the control proceeds via step 1027 to step 1028, thereby carrying out an open-loop control operation. At step 1027, the air-fuel ratio reversion flag FB is reset. Note that, in this case, the amounts RSR and RSL or the means values $\overline{RSR0}$ and $\overline{RSL0}$ thereof are stored in the backup RAM 106, and in an open-loop control operation, the values RSR and RSL or $\overline{RSR0}$ and $\overline{RSL0}$ are read out of the backup RAM 106.

Contrary to the above, if all of the feedback control conditions are satisfied, the control proceeds to steps 1006 through 1026.

At steps 1006, 1007, and 1008, a renewal speeds ΔRS of the rich skip amount RSR and the lean skip amount RSR are calculated. That is, at step 1006, it is determined whether or not the air-fuel ratio reversion flag FB is "0". As a result, if FB="0", the control proceeds to step 1007 which sets ΔRS1 in the renewal speed ΔRS, and if FB="1", the control proceeds to step 1008 which sets ΔRS in the renewal speed ΔRS. Here, ΔRS1<ΔRS2.

Next, at step 1009, an A/D conversion is performed upon the output voltage $V_2$ of the downstream-side $O_2$ sensor 15, and the A/D converted value thereof is then fetched from the A/D converter 101. Then, at step 1010, the voltage $V_2$ is compared with the reference voltage $V_{R2}$ thereby determining whether the current air-fuel ratio detected by the downstream-side $O_2$ sensor 15 is on the rich side or on the lean side with respect to the stoichiometric air-fuel ratio.

At step 1010, if the air-fuel ratio upstream of the catalyst converter 12 is lean, the control proceeds to step 1011 which resets the second air-fuel ratio flag F2. Alternatively, the control proceeds to the step 1012, which sets the second air-fuel ratio flag F2, and then, at step 1013, the air-fuel ratio reversion flag FB is set.

Next, at step 1014, it is determined whether or not the second air-fuel ratio F2 is "0". If F2="0", which means that the air-fuel ratio downstream of the catalyst converter 12 is lean, the control proceeds to steps 1015 through 1020, and if F2="1", which means that the air-fuel ratio is rich, the control proceeds to steps 1021 through 1026.

At step 1015, the rich skip amount RSR is increased by ΔRS to move the air-fuel ratio to the rich side. At steps 1016 and 1018, the rich skip amount RSR is guarded by a maximum value MAX which is, for example, 7.5%.

At step 1018, the lean skip amount RSL is decreased by ΔRS to move the air-fuel ratio to the rich side. At steps 1019 and 1020, the lean skip amount RSL is guarded by a minimum value MIN which is, for example, 2.5%.

On the other hand, if F2="1" (rich), at step 1021, the rich skip amount RSR is decreased by ΔRS to move the air-fuel ratio to the lean side. At steps 1022 and 1023, the rich skip amount RSR is guarded by the minimum value MIN. Further, at step 1024, the lean skip amount RSL is decreased by the definite value ΔRS to move the air-fuel ratio to the rich side. At steps 1025 and 1026, the lean skip amount RSL is guarded by the maximum value MAX.

The skip amounts RSR and RSL are then stored in the backup RAM 106, thereby completing this routine of FIG. 10 at step 1028.

In FIG. 10, the minimum value MIN is a level by which the transient characteristics of the skip operation using the amounts RSR and RSL can be maintained, and the maximum value MAX is a level by which the drivability is not deteriorated by the fluctuation of the air-fuel ratio.

The routine of FIG. 10 will be further explained with reference to FIG. 11.

At time $t_1$, when an air-fuel ratio feedback control for the downstream-side $O_2$ sensor 15 is initiated, the control at step 1006 proceeds to step 1007 which decreases the renewal speed ΔRS of the skip amounts RSR and RSL by ΔRS←ΔRS1, since the air-fuel ratio reversion flag FB is "0".

In this state, the rich skip amount RSR is slowly increased and the lean skip amount RSL is slowly decreased, thus suppressing an overrich state of the skip amounts RSR and RSL.

Next, at time $t_2$, when the output $V_2$ of the downstream-side $O_2$ sensor 15 is switched from the lean side to the rich side, the control at step 1006 proceeds to step 1007 which increases the renewal speed ΔRS of the skip amounts RSR and RSL by, ΔRS←ΔRS2. As a result, the rich skip amount RSR and the lean skip amount RSL are greatly changed to the lean side. Also, the air-fuel ratio reversion flag FB is set by step 1013.

Thereafter, since the air-fuel ratio reversion flag FB is "1", the skip amounts RSR and RSL are changed at a relatively high speed defined by ΔRS2.

Figure 11:
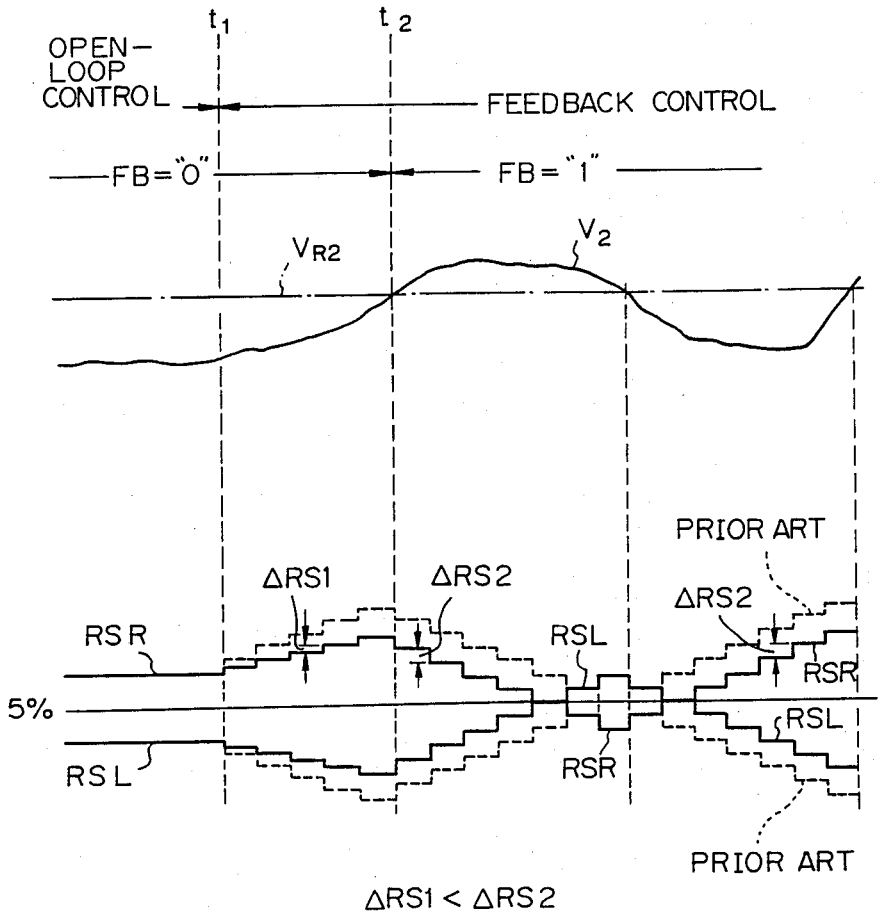

Thus, according to the routine of FIG. 10, the skip amounts RSR and RSL are changed at the relatively low speed ΔRS1 for a time period of from time $t_1$ to time $t_2$ of FIG. 11, and are changed at the relatively high speed ΔRS2 after a time $t_2$ of FIG. 11.

Note that, if the skip amounts RSR and RSL are changed at a relatively high speed (ΔRS=ΔRS2) even for a time period of from time $t_1$ to time $t_2$ as in the prior art, the skip amounts RSR and RSL are overrich as indicated by dotted lines in FIG. 11, and in addition, this overrich state remains for a long time, thus increasing the HC and CO emissions and the fuel consumption. Particularly, when the skip amounts RSR and RSL during an open-loop control mode are kept at values immediately before the open-loop control mode, and in addition, a feedback control for the skip amounts RSR and RSL are started at such values, the skip amounts RSR and RSL are diverged by frequent repetitions of the feedback control and the open-loop control. According to the present invention, the divergence of the skip amounts RSR and RSL is avoided.

Figure 12:
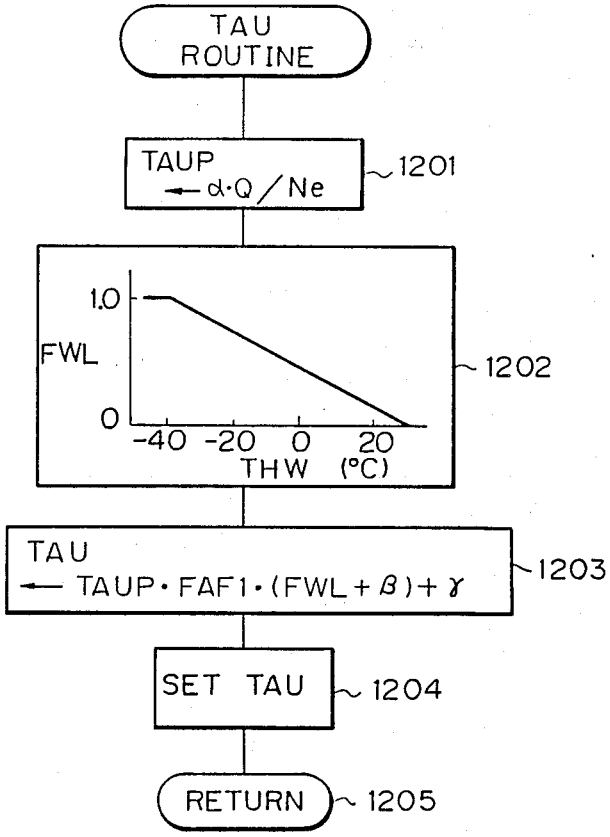

FIG. 12 is a routine for calculating a fuel injection amount TAU executed at every predetermined crank angle such as 360° CA. At step 1201, a base fuel injection amount TAUP is calculated by using the intake air amount data Q and the engine speed data Ne stored in the RAM 105. That is, $$TAUP \in \alpha \cdot Q/Ne$$

where α is a constant. Then at step 1202, a warming-up incremental amount FWL is calculated from a one-dimensional map by using the coolant temperature data THW stored in the RAM 105. Note that the warming-up incremental amount FWL decreased when the coolant temperature THW increases. At step 1203, a final fuel injectional amount TAU is calculated by $$TAU \leftarrow TAUP \cdot FAF1 \cdot (FWL+\beta)+\gamma$$

where β and γ are correction factors determined by other parameters such as the voltage of the battery and the temperature of the intake air. At step 1204, the final fuel injection amount TAU is set in the down counter 108, and in addition, the flip-flop 109 is set to initiate the activation of the fuel injection valve 7. This routine is then completed by step 1205. Note that, as explained above, when a time period corresponding to the amount TAU has passed, the flip-flop 109 is reset by the carry-out signal of the down counter 108 to stop the activation of the fuel injection valve 7.

Figures 13, 13A:
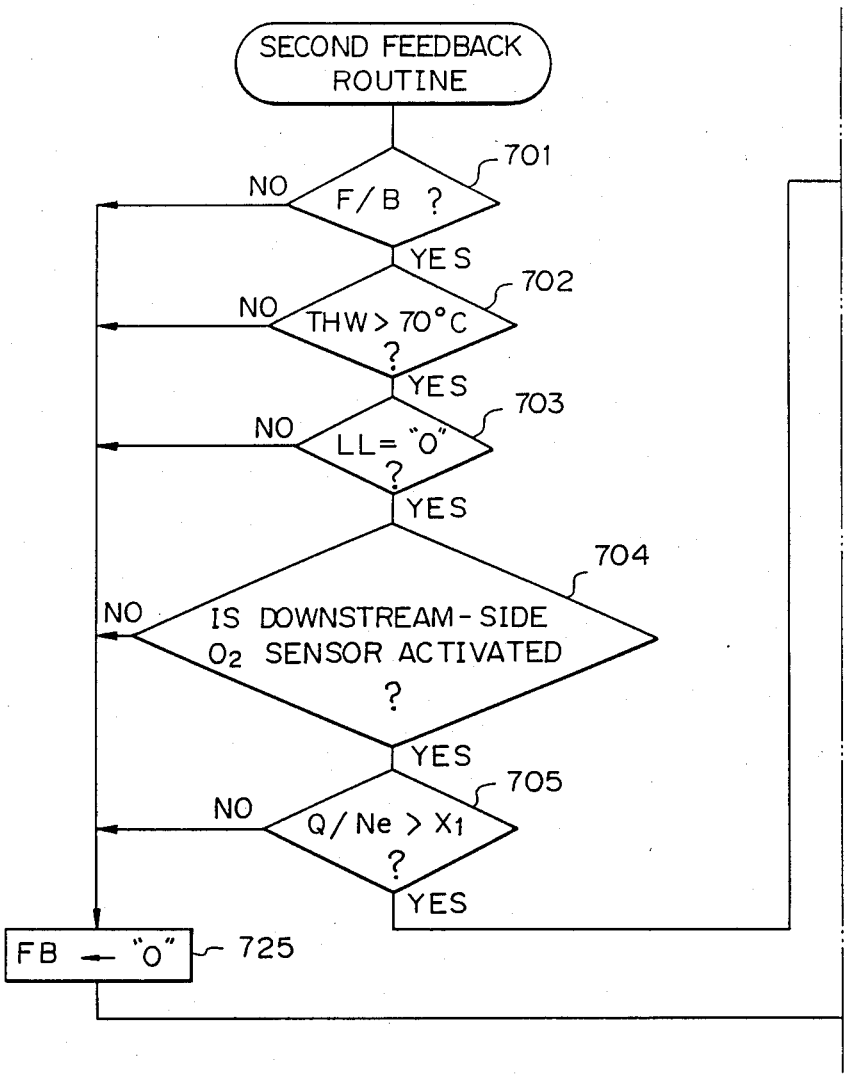
Figure 13B:
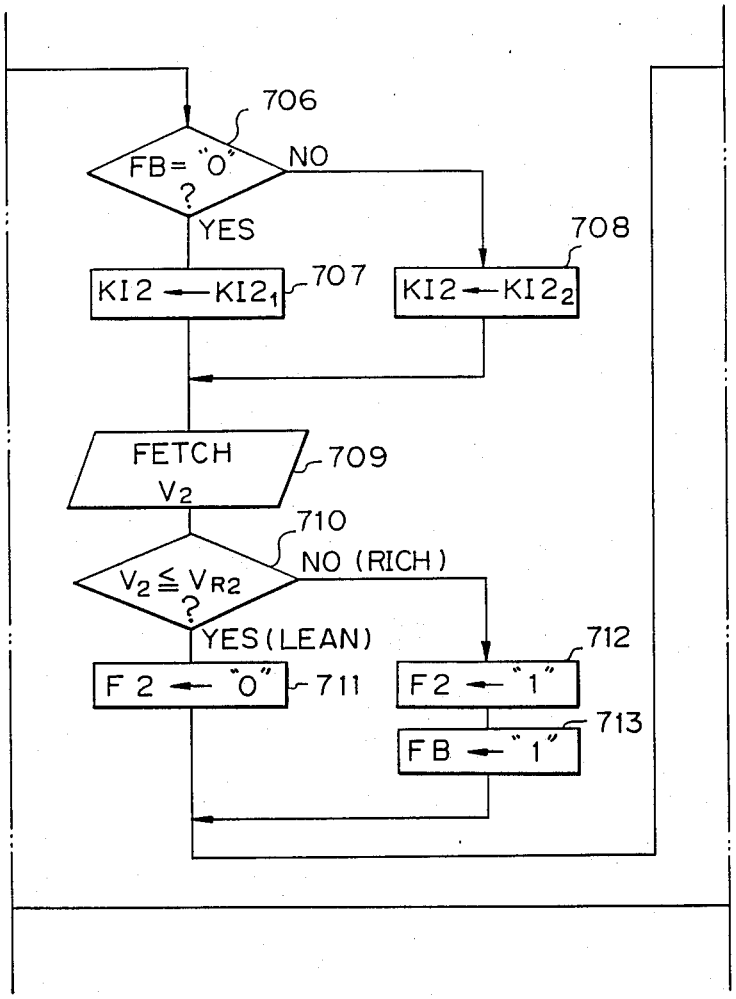
Figure 13C:
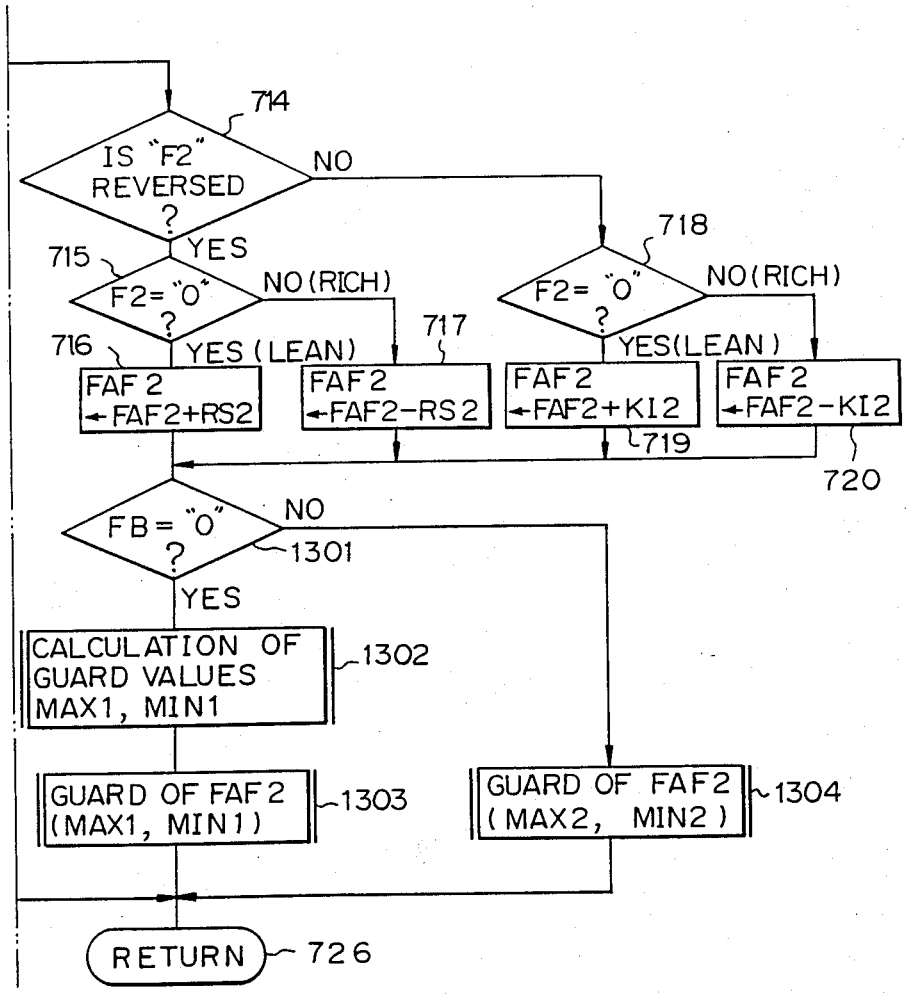
Figure 14:
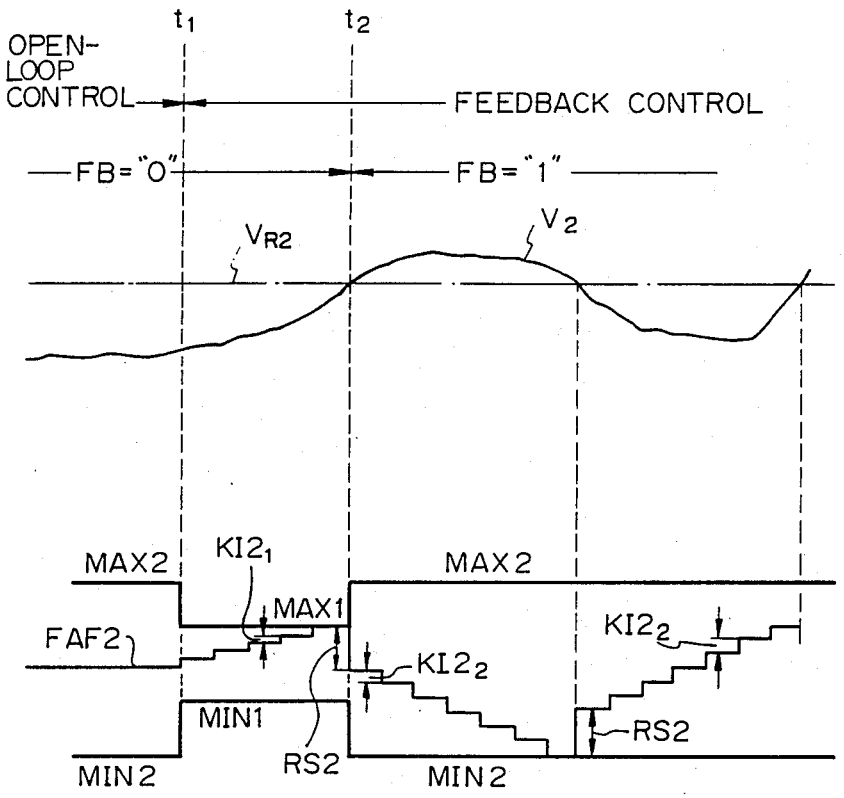

In FIG. 13, which is a modification of FIG. 7, steps 1301 through 1304 are provided instead of steps 721 through 724 of FIG. 7. At step 1301, it is determined whether or not the air-fuel ratio reversion flag FB is "0". Referring to FIG. 14, when at time $t_1$, FB is "1", then the control at step 1301 proceeds to step 1302 which calculates a small allowable range of the second air-fuel ratio correction amount FAF2. That is, the second air-fuel ratio correction amount FAF2 ($=FAF2_0$), which is stored in the backup RAM 106 immediately before the air-fuel ratio feedback control for the downstream-side $O_2$ sensor 15, is read out of the backup RAM 106, and a maximum value MAX1 and a minimum value MIN1 are calculated by $$MAX1 \leftarrow FAF2_0 \times a$$

$$MIN1 \leftarrow FAF2_0 \times b$$

where a is a definite value of 1.05 to 1.10, and b is a definite value of 0.90 to 0.95. Note that the maximum value MAX1 and the minimum value MINl can be definite values such as 1.10 and 0.9, respectively. Also, the maximum value MAX1 and the minimum value MIN1 can be determined by $$MAX1 \leftarrow FAF2MAX$$

$$MIN1 \leftarrow FAF2MIN$$

where FAF2MAX and FAF2MIN are a maximum value and a minimum value, respectively, of the second air-fuel ratio correction amount FAF2 during an air-fuel ratio feedback control mode for the downstream-side $O_2$ sensor 15. Also, the maximum value MAX1 and the minimum value MIN1 can be determined by $$MAX1 \leftarrow FAF2MAX$$

$$MIN1 \leftarrow FAF2MIN$$

where FAF2MAX and FAF2MIN are a mean value or a blunt value of local maximum values and a mean value or a blunt value of local minimum values, respectively, of the second air-fuel ratio correction amount FAF2 during an air-fuel ratio feedback control mode for the downstream-side $O_2$ sensor 15. Then, at step 1302, the second air-fuel ratio correction amount FA2 is guarded by the maximum value MAX1 and the minimum value MIN1.

Next, at time $t_2$ of FIG. 14, when the output $V_2$ of the downstream-side $O_2$ sensor 15 is switched from the lean side to the rich side, the air-fuel reversion flag FB is reversed from "0" to "1", so that the control proceeds to step 1304 which imposes a large allowable range upon the second air-fuel ratio correction amount FAF2. Such a large allowable range is defined by a maximum value MAX2 and a minimum value MIN2 which are, in this case, 1.2 and 0.8, respectively.

Then, after time $t_2$ of FIG. 14, when the air-fuel ratio feedback control for the downstream-side $O_2$ sensor 15 continues so that the air-fuel ratio reversion flag FB remains at "1", the second air-fuel ratio correction amount FAF2 is guarded by the large allowable range defined by the maximum value MAX2 and the minimum value MIN2 of step 1304.

Thus, in the routine of FIG. 13, due to the presence of the small allowable range MIN1, MAX1, the over-correction of the second air-fuel ratio correction amount FAF2 can be more effectively avoided, compared with the routine of FIG. 7.

Figures 15, 15A:
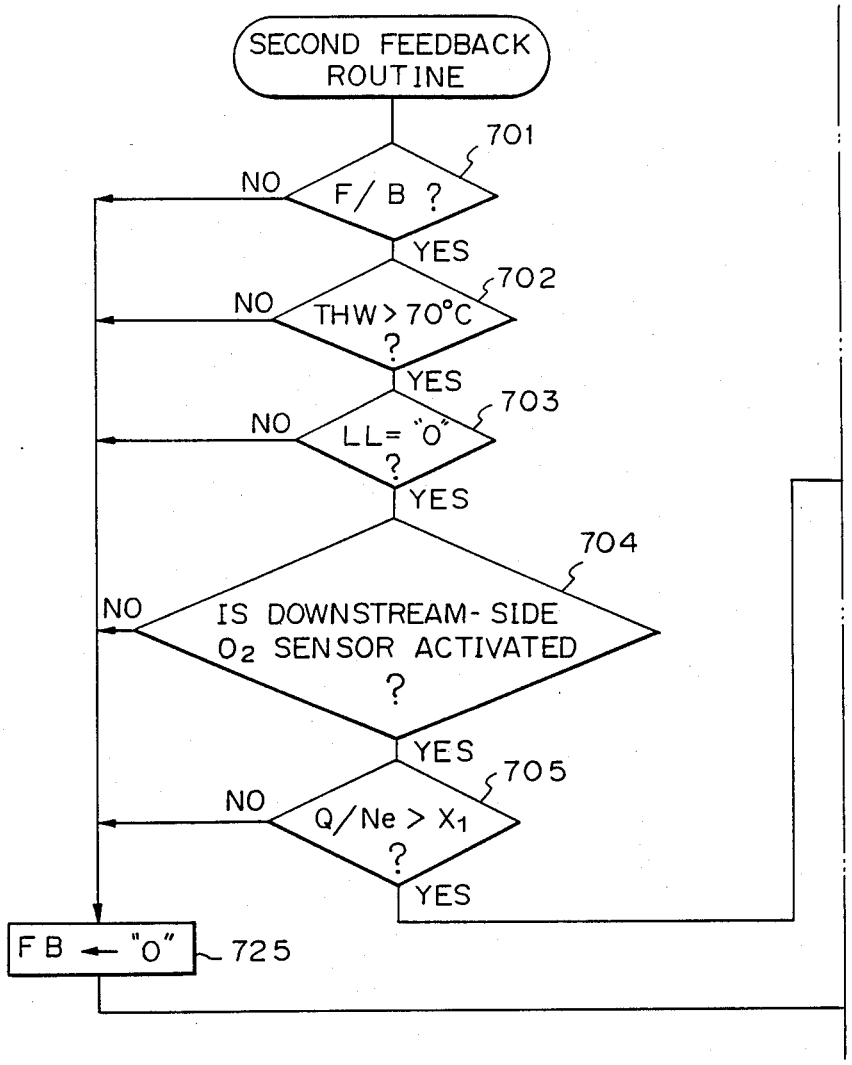
Figure 15B:
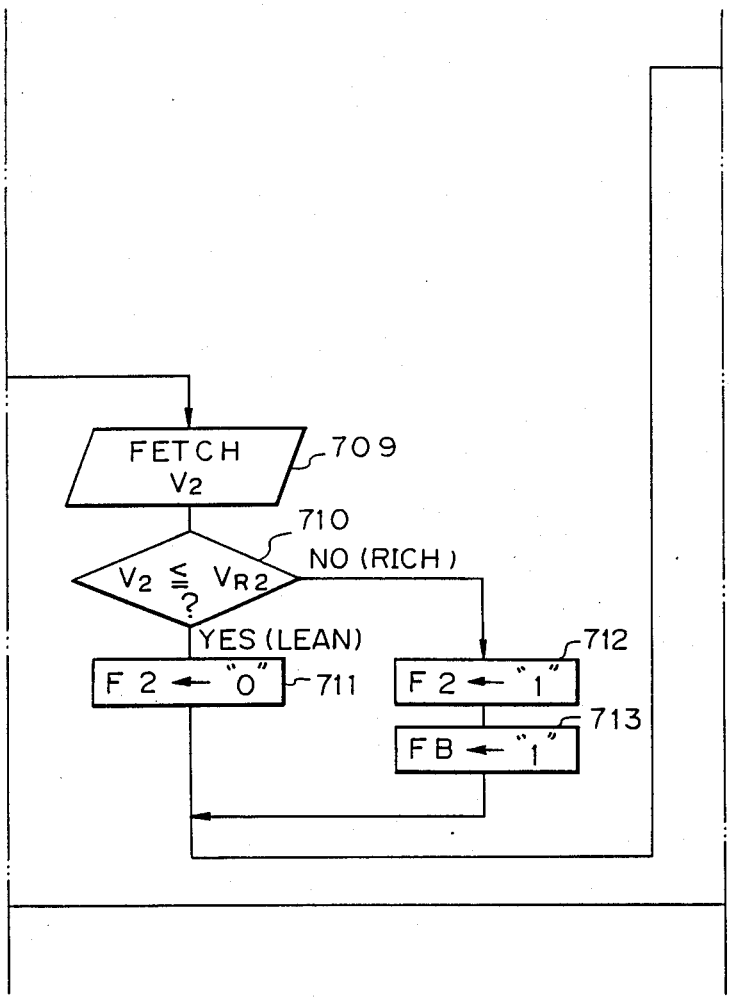
Figure 15C:
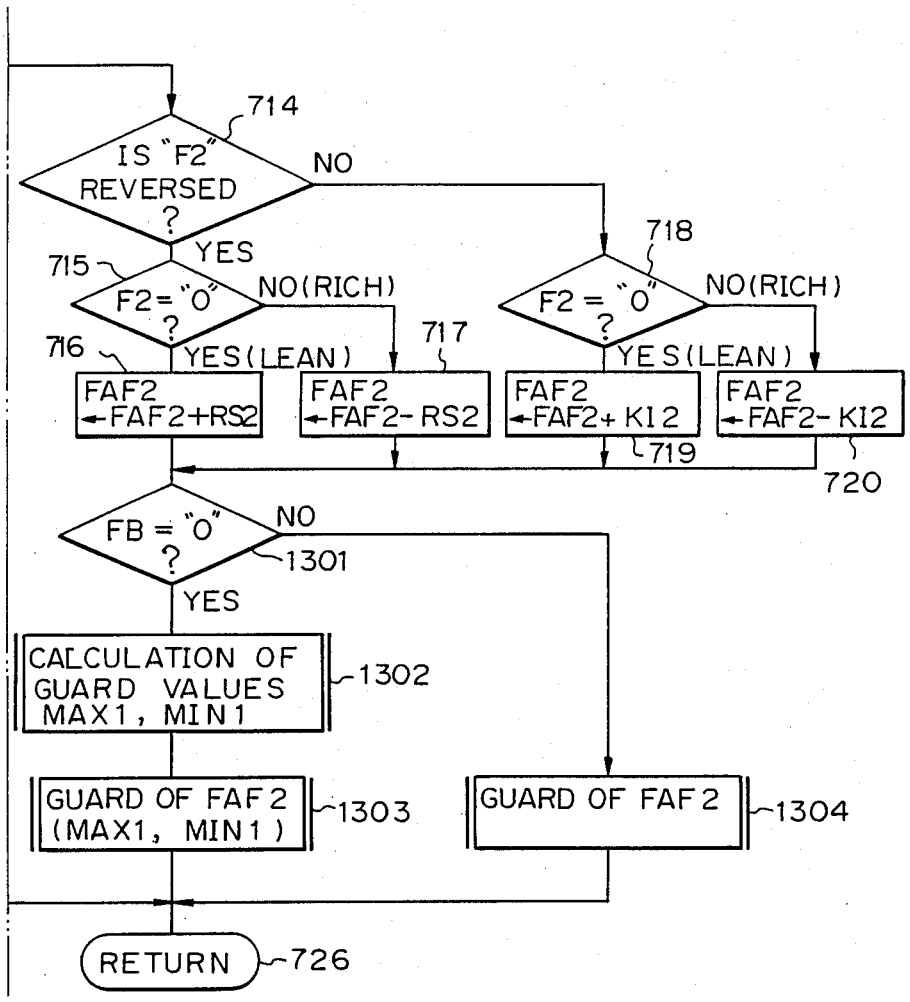
Figure 16:
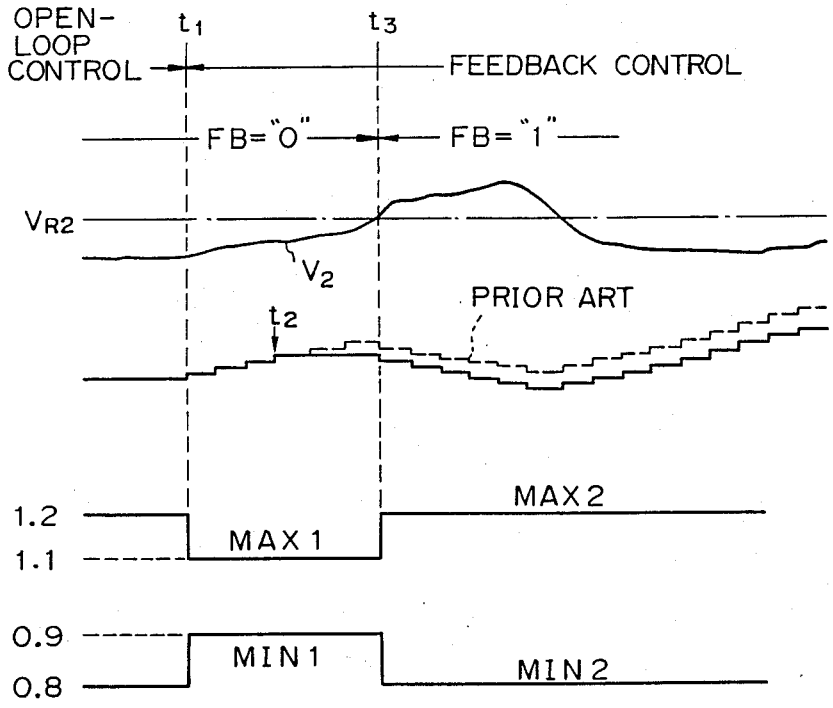

In FIG. 15, which is a modification of FIG. 13, steps 706, 707, and 708 of FIG. 13 are deleted. In this case, referring to FIG. 16, although the second air-fuel ratio correction amount FAF2 is changed at a large renewal speed from time $t_1$ to time $t_3$, at time $t_2$, the second air-fuel ratio correction amount FAF2 adheres to the maximum value MAX1, and therefore, the correction of the second air-fuel ratio correction amount FAF2 is substantially prohibited, thus also suppressing the over-correction of the second air-fuel ratio correction amount FAF2.

Figures 17, 17A:
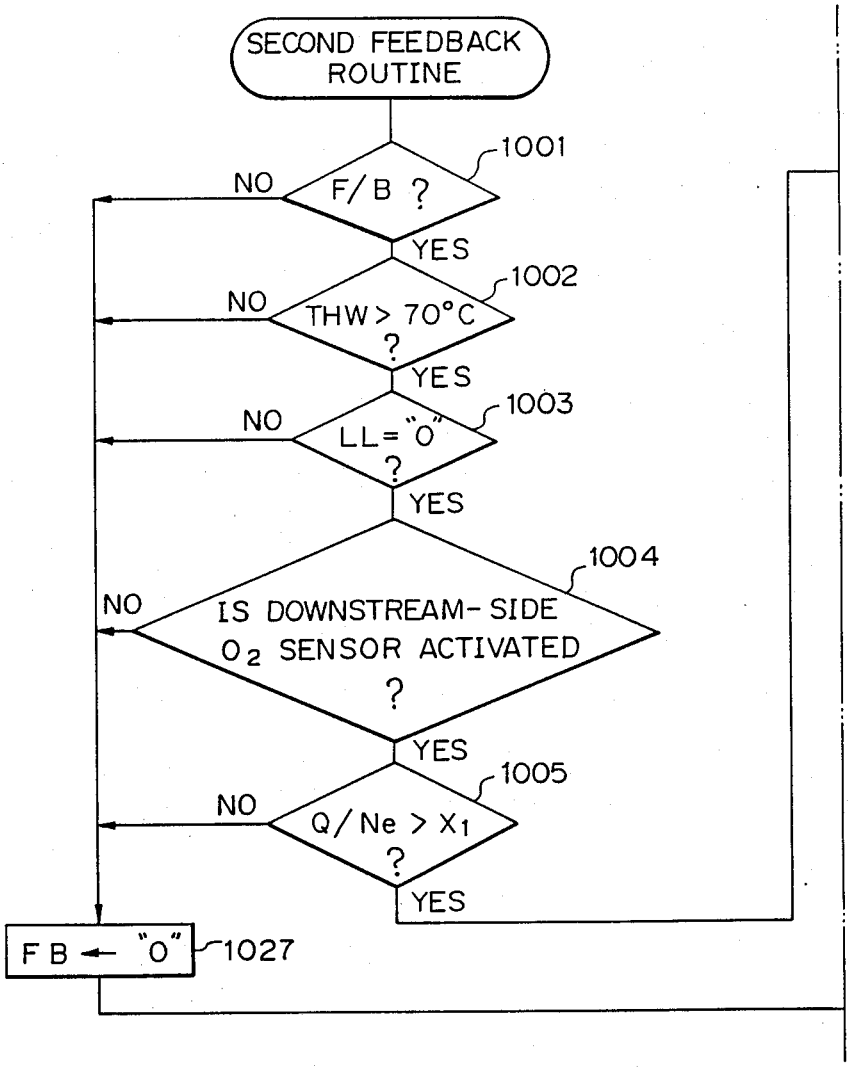
Figure 17B:
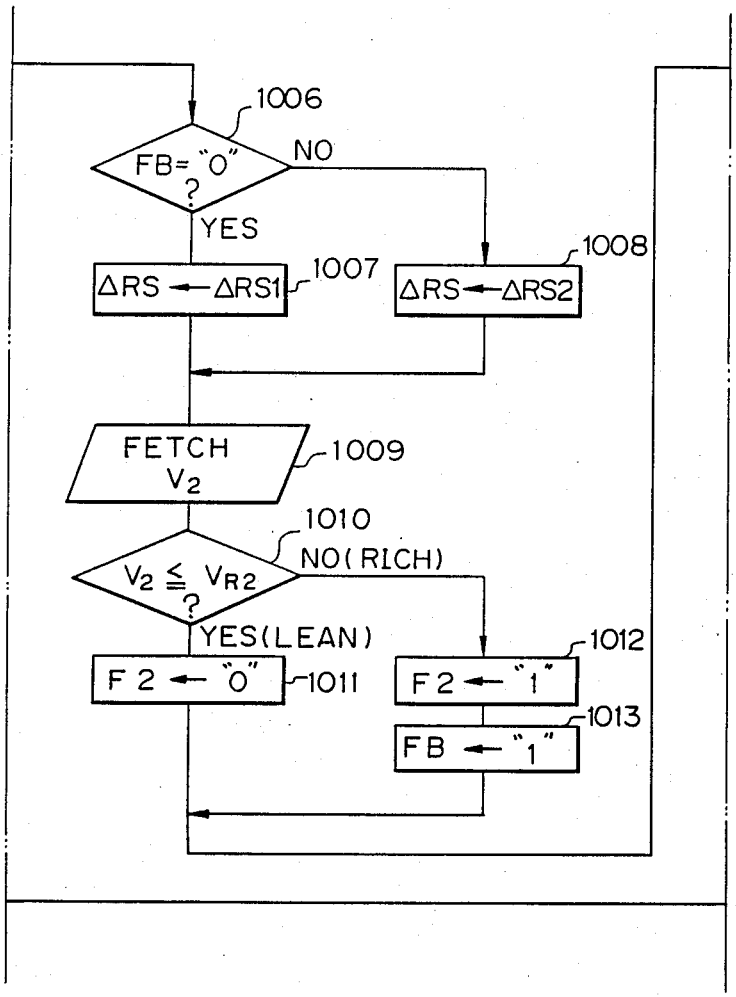
Figure 17C:
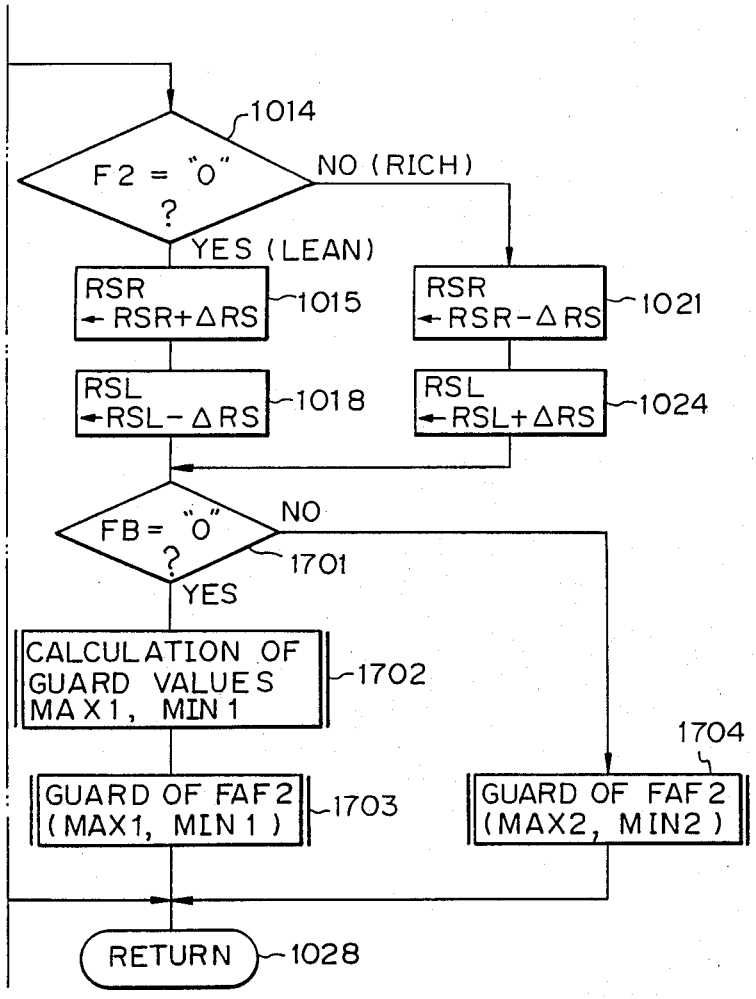
Figure 18:
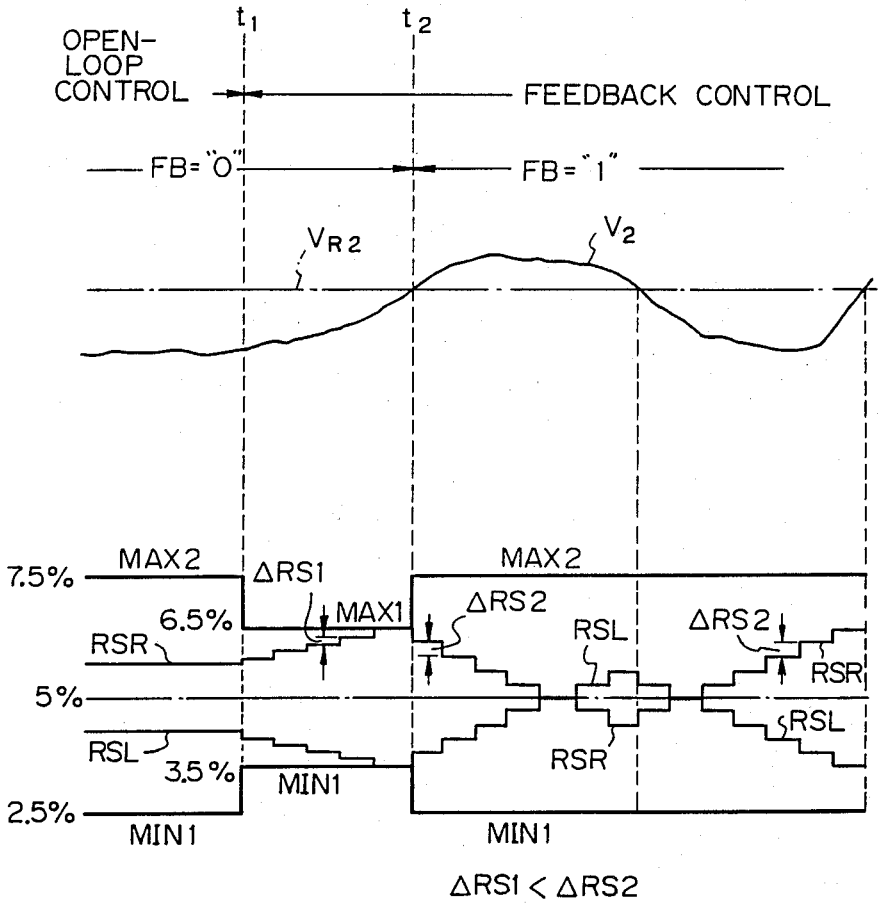

In FIG. 17, which is a modification of FIG. 10, steps 1701 through 1704 are provided instead of steps 1016, 1017, 1019, 1020, 1022, 1023, 1025, and 1026 of FIG. 10. At step 1701, it is determined whether or not the air-fuel ratio reversion flag FB is "0". Referring to FIG. 18, when at time $t_1$, FB="0", then the control at step 1701 proceeds to step 17O2 which calculates a small allowable range of the skip amounts RSR and RSL. That is, the skip amounts RSR ($=RSR_0$) and RSL ($=RSL_0$), which is stored in the backup RAM 106 immediately before the air-fuel ratio feedback control for the downstream-side $O_2$ sensor 15, is read out of the backup RAM 106, and it is determined whether or not $RSR_0 \geqq RSL_0$. For example, if $RSR_0 \geqq SRL_0$, a maximum value MAX1 and a minimum value MINl are calculated by $$MAX1 \leftarrow RSR_0 \times a$$

$$MIN1 \leftarrow RSL_0 \times b$$

where a is a definite value of 1.05 to 1.10, and b is a definite value of 0.90 to 0.95. Note that the maximum value MAX1 and the minimum value MINl can be definite values such as 6.5% and 3.5%, respectively. Also, the maximum value MAX1 and the minimum value MIN1 can be determined by $$MAX1 \leftarrow RSMAX$$

$$MIN1 \leftarrow RSMIN$$

where RSMAX and RSMIN are a maximum value and a minimum value, respectively, of the skip amounts RSR and RSL during an air-fuel ratio feedback control mode for the downstream-side $O_2$ sensor 15. Also, the maximum value MAX1 and the minimum value MIN1 can be determined by $$MAX1 \leftarrow RSMAX$$

$$MIN1 \leftarrow RSMIN$$

where RSMAX and RSMIN are a mean value or a blunt value of local maximum values and a mean value or a blunt value of local minimum values, respectively, of the skip amounts RSR and RSL during an air-fuel ratio feedback control mode for the downstream-side $O_2$ sensor 15. Then, at step 1702, the skip amounts RSR and RSL are guarded by the maximum value MAX1 and the minimum value MIN1.

Next, at time $t_2$ of FIG. 18, when the output $V_2$ of the downstream-side $O_2$ sensor 15 is switched from the lean side to the rich side, the air-fuel reversion flag FB is reversed from "0" to "1", so that the control proceeds to step 1704 which imposes a large allowable range upon the skip amounts RSR and RSL. Such a large allowable range is defined by a maximum value MAX2 and a minimum value MIN2 which are, in this case, 7.5% and 2.5%, respectively.

Then, after time $t_2$ of FIG. 18, when the air-fuel ratio feedback control for the downstream-side $O_2$ sensor 15 continues so that the air-fuel ratio reversion flag FB remains at "1", the skip amounts RSR and RSL are guarded by the large allowable range defined by the maximum value MAX2 and the minimum value MIN2 at step 1704.

Thus, in the routine of FIG. 18, due to the presence of the small allowable range MIN1, MAX1, the overcorrection of the skip amounts RSR and RSL can be more effectively avoided, compared with the routine of FIG. 10.

Figures 19, 19A:
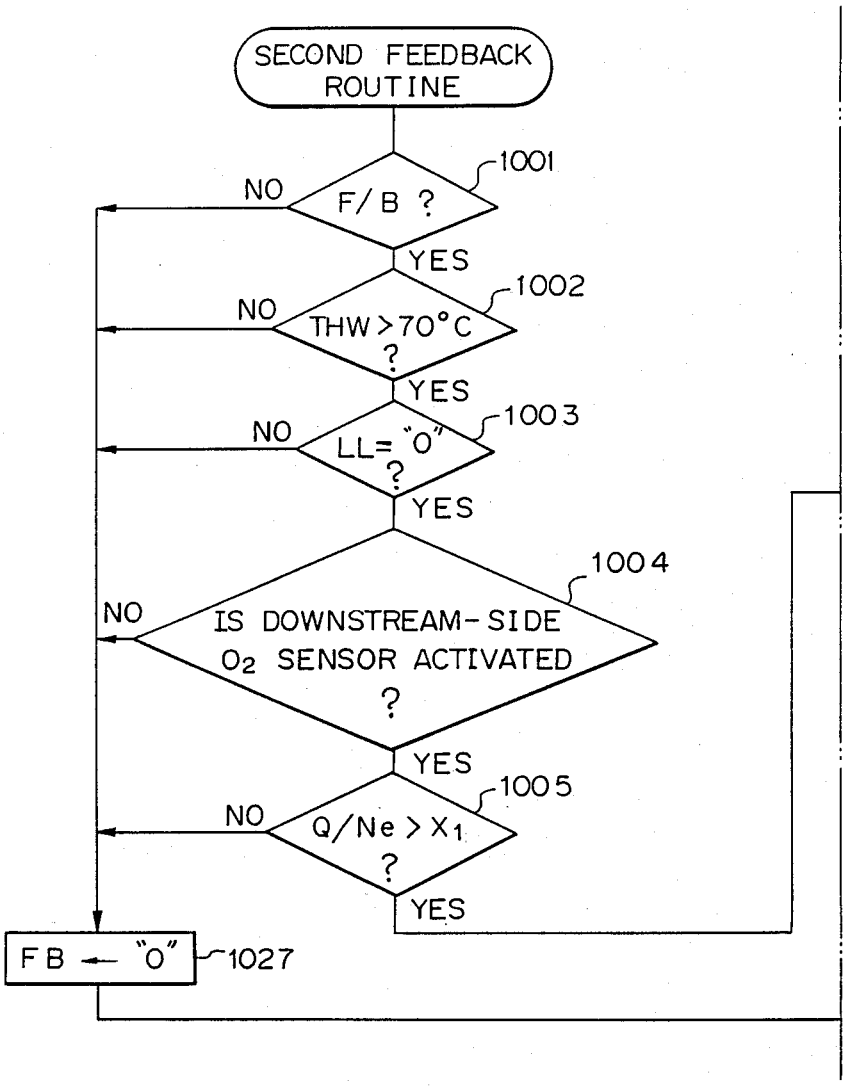
Figure 19B:
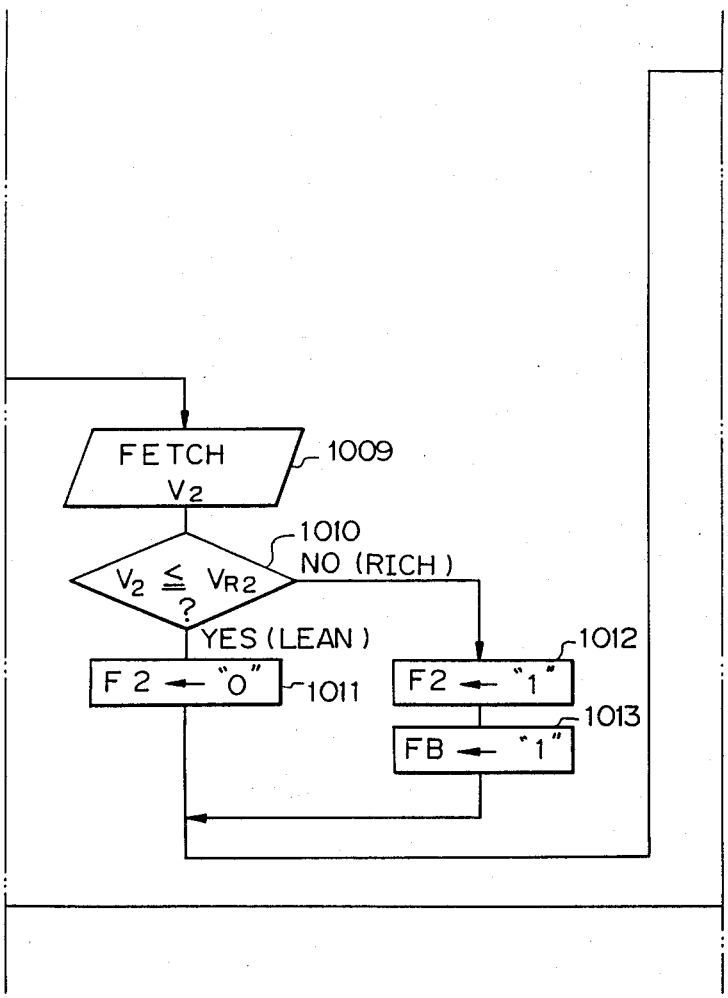
Figure 19C:
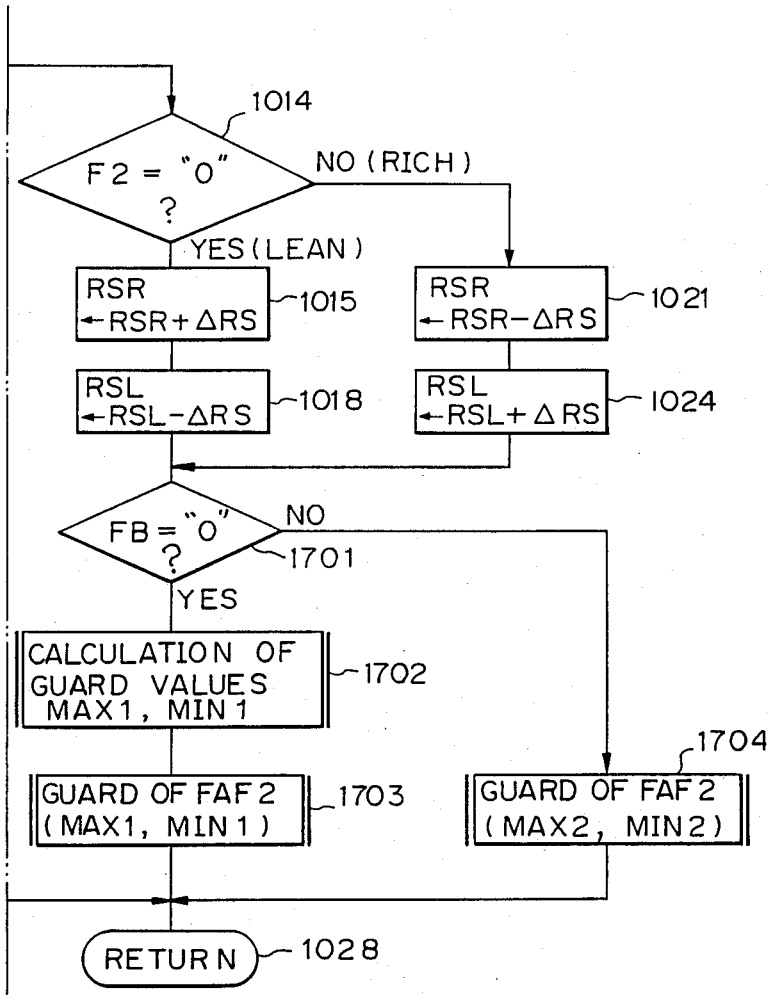
Figure 20:
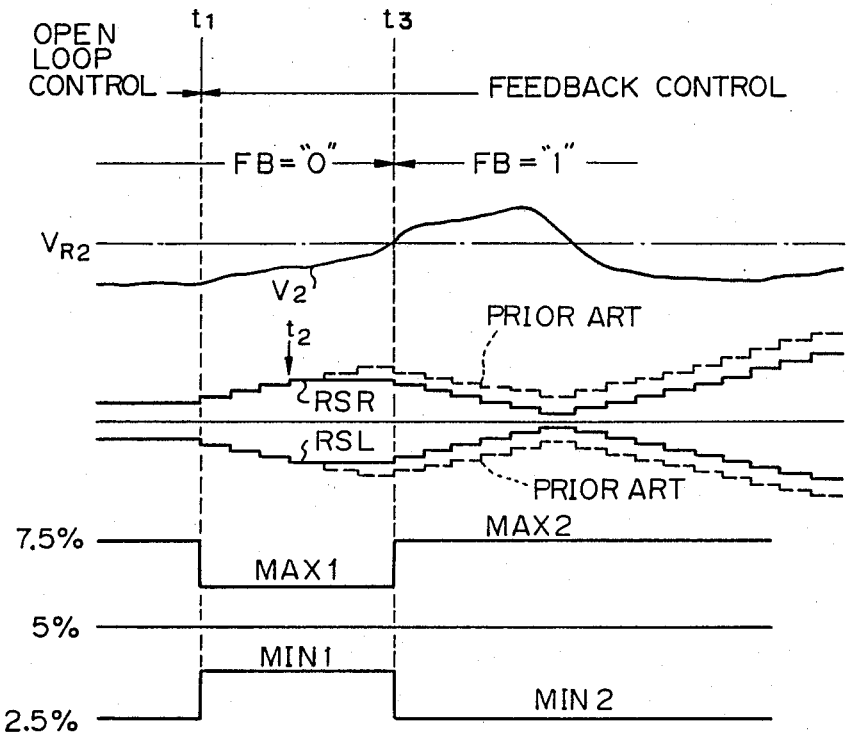

In FIG. 19, which is a modification of FIG. 17, steps 1006, 1007, and 1008 of FIG. 17 are deleted. In this case, referring to FIG. 20, although the skip amounts RSR and RSL are changed at a large renewal speed $\Delta RS2$ from time $t_1$ to time $t_3$, at time $t_2$, the skip amounts RSR and RSL are adhere to the maximum value MAX1 and the minimum value MIN1, respectively, and therefore, the correction of the skip amounts RSR and RSL are substantially prohibited, thus also suppressing the over-correction of the skip amounts RSR and RSL.

Figures 21, 21A:
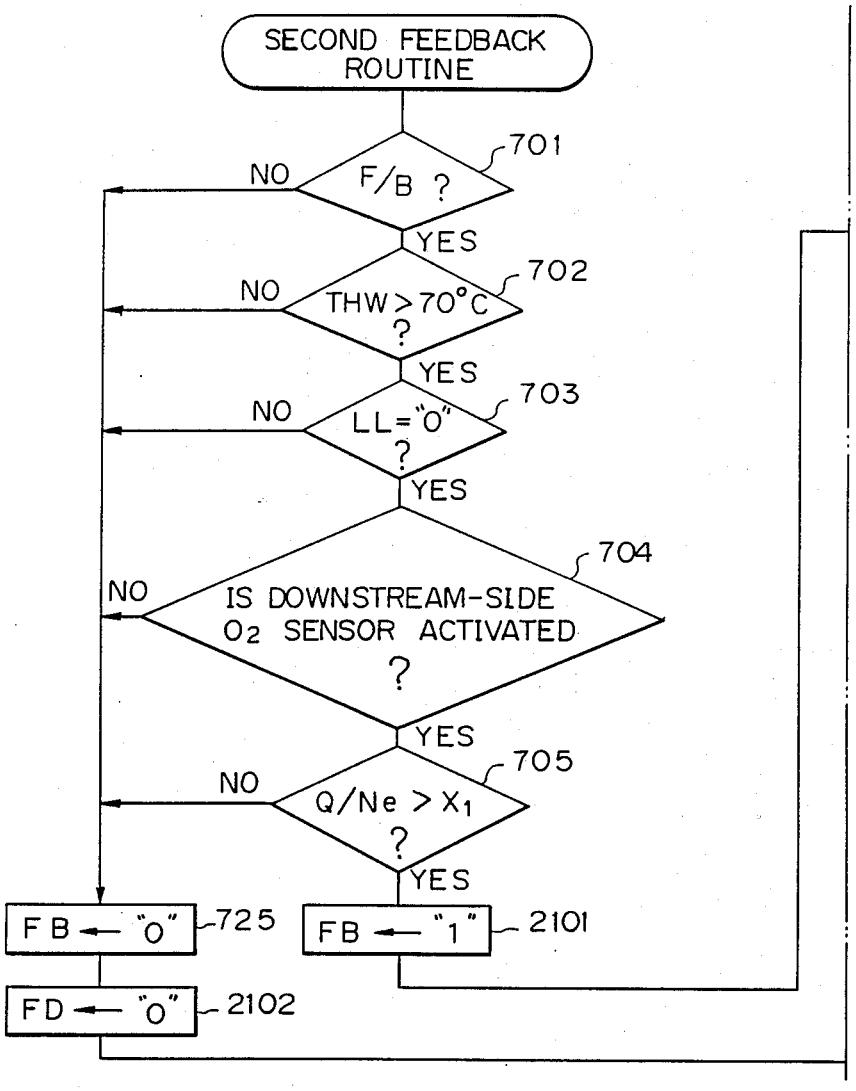
Figure 21B:
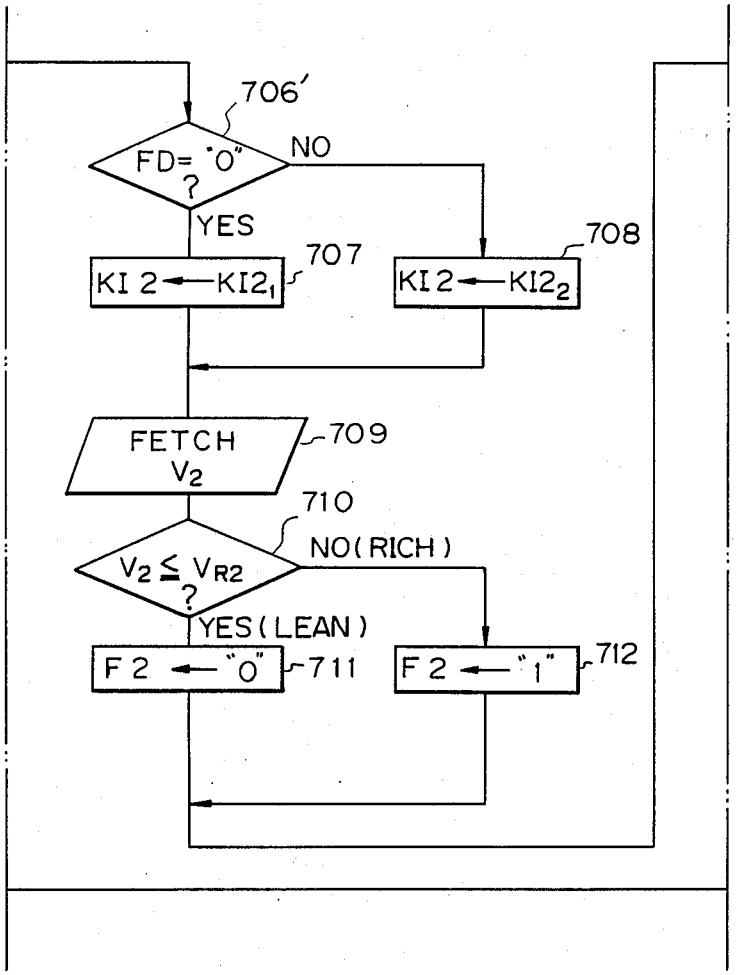
Figure 21C:
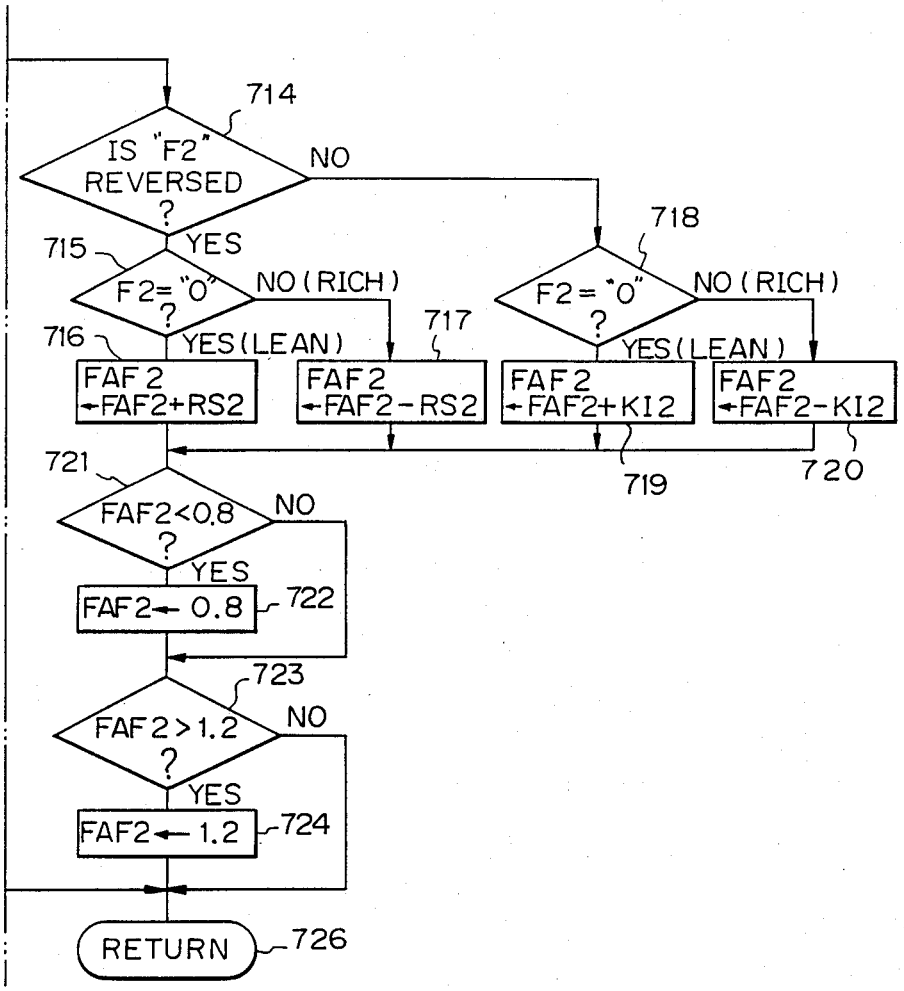
Figure 22:
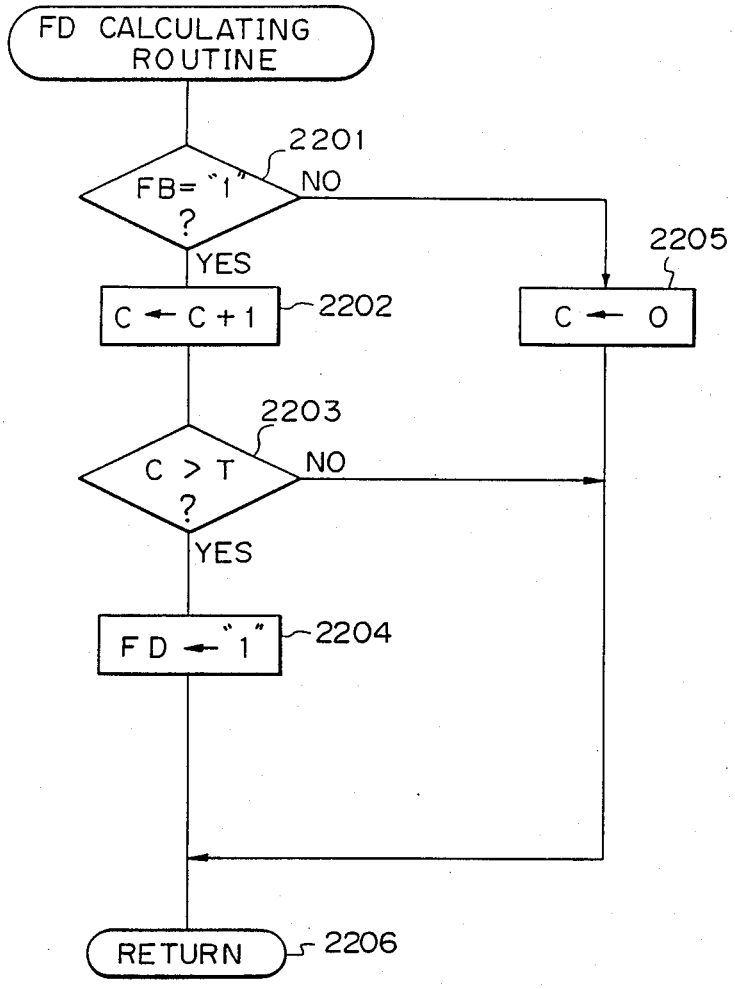

In FIG. 21, which is also a modification of FIG. 7, step 713 is deleted, and steps 2101 and 2102 are added. Also, step 706 is changed to step 706'. Note that, in this case, the flag FB (="1") indicates that all the feedback control conditions for the downstream-side $O_2$ sensor 15 are satisfied. Also, a delay flag FD is set by a routine of FIG. 22 when a predetermined time period has been passed after all the feedback control conditions for the downstream-side $O_2$ sensor 15 are satisfied. Therefore, a speed of renewal of the second air-fuel ratio correction amount FAF2 is lowered for the predetermined time period after all the feedback control conditions for the downstream-side $O_2$ sensor 15 are satisfied. Thus, the overcorrection of the second air-fuel ratio correction amount FAF2 can be effectively avoided FIG. 22 is a routine for calculating the delay flag FD of FIG. 21 executed at every predetermined time period such as 4 ms. At step 2201, it is determined whether or not all the feedback control conditions for the downstream-side $O_2$ sensor 15 are satisfied by the flag FB. If FB="0", the control proceeds to step 2205 which resets the delay flag FD. Otherwise, the control proceeds to step 2202 which counts up the value of a counter C by+1. Then, at step 2203, it is determined whether or not the value of the counter C is larger than a predetermined value T, i.e., whether or not a predetermined time period has been passed. Only if C>T, the control proceeds to step 2204 which sets the delay flag FD.

Figures 23, 23A:
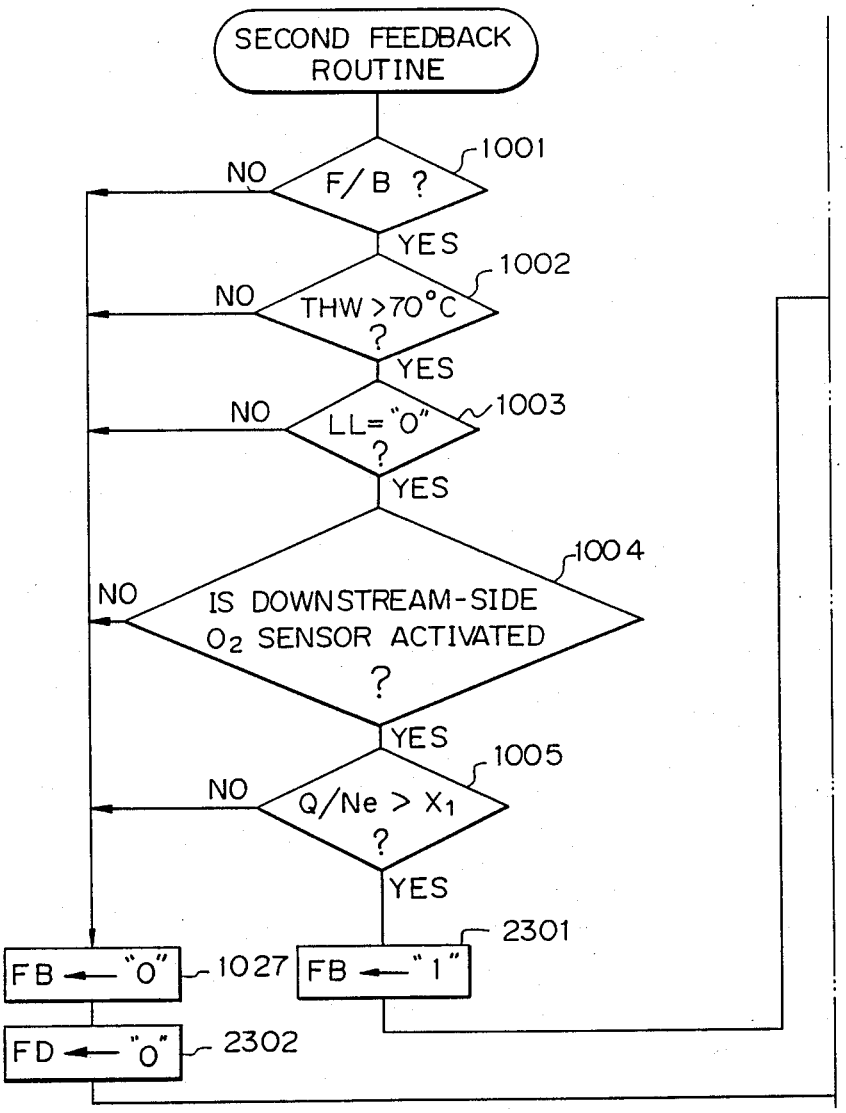
Figure 23B:
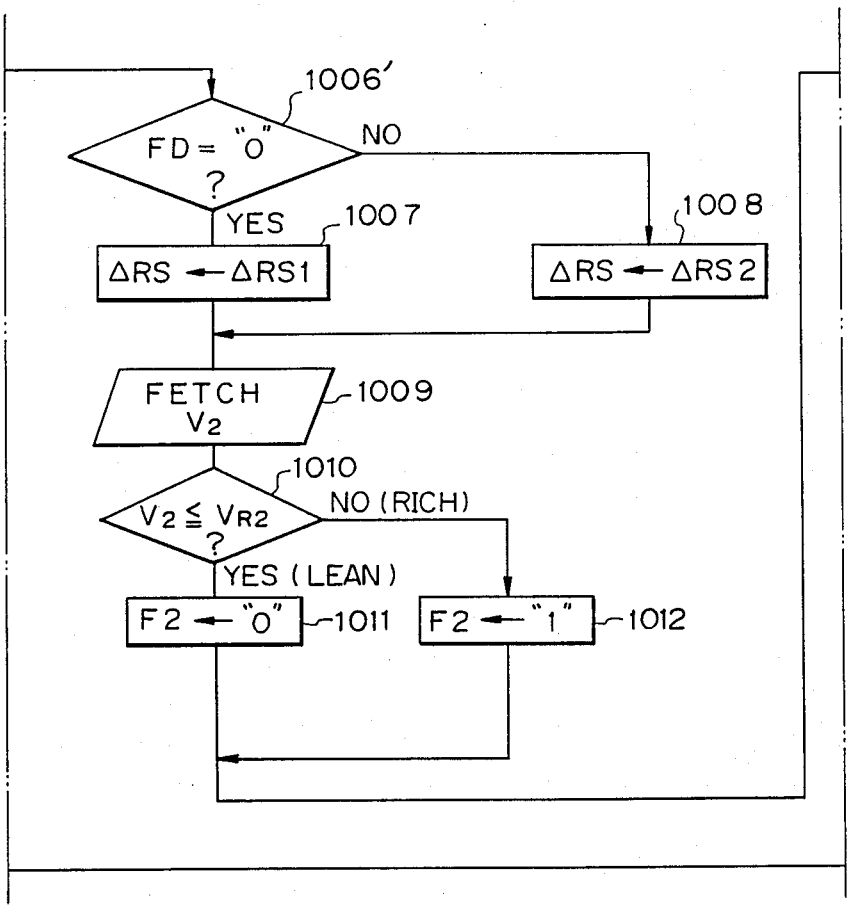
Figure 23C:
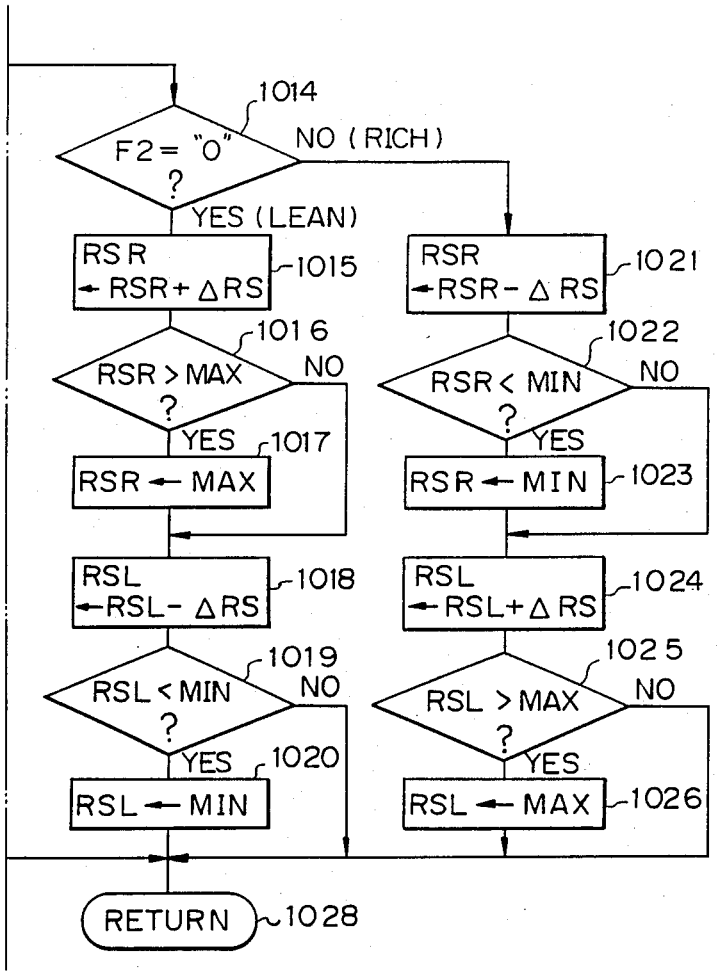

In FIG. 23, which is also a modification of FIG. 10, step 1013 is deleted, and steps 2301 and 2302 are added. Also, step 1006 is changed to step 1006'. Note that, also in this case, the flag FB (="1") indicates that all the feedback control conditions for the downstream-side $O_2$ sensor 15 are satisfied.

In the routine of FIG. 23, a speed of renewal of the rich skip amounts RSR and RSL are lowered for the predetermined time period after all the feedback control conditions for the downstream-side $O_2$ sensor 15 are satisfied. Thus, the overcorrection of the skip amounts RSR and RSL can be also effectively avoided.

Note that the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR and TDL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 901 of FIG. 9 or at step 1201 or FIG. 12 is determined by the carburetor itself, i.e., the intake air negative pressure and the engine speed, and the air amount corresponding to TAU at step 903 of FIG. 9 or at step 1203 of FIG. 12.

Further, a CO sensor, a lean-mixture sensor or the like can be also used instead of the $O_2$ sensor As explained above, according to the present invention, when the control is transferred from an open-loop control mode for the downstream-side air-fuel ratio sensor to an air-fuel ratio feedback control mode for the downstream-side air-fuel ratio sensor, a speed of renewal of the air-fuel ratio correction in accordance with the downstream-side air-fuel ratio sensor is lowered before the output thereof is reversed or for a predetermined time period, thereby avoiding overcorrection of the air-fuel ratio correction amount, and thus improving the emission and fuel consumption characteristics.

We claim:

1. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

determining whether or not all air-fuel ratio feedback control conditions for said downstream-side air-fuel ratio sensor are satisfied;

calculating an air-fuel ratio correction amount in accordance with the outputs of said upstream-side and downstream-side air-fuel ratio sensors when all of said air-fuel ratio feedback control conditions are satisfied;

determining whether or not the output of said downstream-side air-fuel ratio sensor is reversed;

lowering a speed of renewal of said air-fuel ratio correction amount in accordance with the output of said downstream-side air-fuel ratio sensor after all of the air-fuel ratio feedback control conditions for said downstream-side air-fuel ratio sensor are satisfied and until the output of said downstream-side air-fuel ratio sensor is reversed; and adjusting an actual air-fuel ratio in accordance with said air-fuel ratio correction amount.

2. A method as set forth in claim 1, wherein said renewal speed lowering is carried out only when the output of said downstream-side air-fuel ratio sensor indicates a lean state.

3. A method as set forth in claim 1, wherein said air-fuel ratio correction amount calculating step comprises the steps of:

calculating a first air-fuel ratio correction amount in accordance with the output of said upstream-side air-fuel ratio sensor; and calculating a second air-fuel ratio correction amount in accordance with the output of said downstream-side air-fuel ratio sensor, said air-fuel ratio correction amount calculating step calculating said air-fuel ratio correction amount in accordance with said first and second air-fuel ratio correction amounts.

4. A method as set forth in claim 3, wherein, when at least one of the feedback control conditions for said downstream-side air-fuel ratio sensor is not satisfied, said second air-fuel ratio correction amount is a value of said second air-fuel ratio correction amount immediately before at least one of the air-fuel ratio feedback control conditions for said downstream-side air-fuel ratio sensor is not satisfied.

5. A method as set forth in claim 3, wherein said second air-fuel ratio correction amount calculating step comprises the steps of:

remarkably increasing said second air-fuel ratio correction amount by a rich skip amount when the output of said downstream-side air-fuel ratio sensor is switched from the rich side to the lean side; and remarkably decreasing said second air-fuel ratio correction amount by a lean skip amount when the output of said downstream-side air-fuel ratio sensor is switched from the lean side to the rich side, said renewal speed lowering step reducing said rich and lean skip amounts.

6. A method as set forth in claim 3, wherein said second air-fuel ratio correction amount calculating step comprises the steps of:

gradually increasing said second air-fuel ratio correction amount by a rich integration amount when the output of said downstream-side air-fuel ratio sensor indicates a lean state; and gradually decreasing said air-fuel ratio correction amount by a lean integration amount when the output of said downstream-side air-fuel ratio sensor indicates a rich state, said renewal speed lowering step reducing said rich and lean integration amounts.

7. A method as set forth in claim 3, further comprising the steps of:

lowering a renewal speed of said second air-fuel ratio correction amount after all of the air-fuel ratio feedback control conditions for said downstream-side air-fuel ratio sensor are satisfied and until the output of said downstream-side air-fuel ratio sensor is reversed; and imposing an allowable range on said second air-fuel ratio correction amount.

8. A method as set forth in claim 7, wherein said allowable range imposing step imposes said second air-fuel ratio correction amount only when the output of said downstream-side air-fuel ratio sensor indicates a lean state.

9. A method as set forth in claim 7, wherein said allowable range imposing step imposes a decreased allowable range in accordance with said second air-fuel ratio correction amount immediately before all of the feedback control conditions for said downstream-side air-fuel ratio sensor are satisfied.

10. A method as set forth in claim 7, wherein said allowable range imposing step imposes a decreased allowable range in accordance with a maximum value and a minimum value of said second air-fuel ratio correction amount when all of the feedback control conditions for said downstream-side air-fuel ratio sensor are satisfied.

11. A method as set forth in claim 7, wherein said allowable range imposing step imposes a decreased allowable range in accordance with a blunt value of local maximum values and a blunt value of local minimum values of said second air-fuel ratio correction amount when all of the feedback control conditions for said downstream-side air-fuel ratio sensor are satisfied.

12. A method as set forth in claim 1, wherein said air-fuel ratio correction amount calculating step comprises the steps of:

calculating an air-fuel ratio feedback control parameter in accordance with the output of said downstream-side air-fuel ratio sensor; and calculating said air-fuel ratio correction amount in accordance with the output of said upstream-side air-fuel ratio sensor and said air-fuel ratio feedback control parameter.

13. A method as set forth in claim 12, wherein, when at least one of the feedback control conditions for said downstream-side air-fuel ratio sensor is not satisfied, said air-fuel ratio feedback control parameter is a value of said air-fuel ratio feedback control parameter immediately before at least one of the air-fuel ratio feedback control conditions for said downstream-side air-fuel ratio sensor is not satisfied.

14. A method as set forth in claim 12, further comprising the steps of:

lowering a renewal speed of said air-fuel ratio feedback control parameter after all of the air-fuel ratio feedback control conditions for said downstream-side air-fuel ratio sensor are satisfied and until the output of said downstream-side air-fuel ratio sensor is reversed; and imposing an allowable range on said air-fuel ratio feedback control parameter.

15. A method as set forth in claim 14, wherein said allowable range imposing step imposes said air-fuel ratio feedback control parameter only when the output of said downstream-side air-fuel ratio sensor indicates a lean state.

16. A method as set forth in claim 14, wherein said allowable range imposing step imposes a decreased allowable range in accordance with said air-fuel ratio feedback control parameter amount immediately before all the feedback control conditions for said downstream-side air-fuel ratio sensor are satisfied.

17. A method as set forth in claim 14, wherein said allowable range imposing step imposes a decreased allowable range in accordance with a maximum value and a minimum value of said air-fuel ratio feedback control parameter when all of the feedback control conditions by said downstream-side air-fuel ratio sensor are satisfied.

18. A method as set forth in claim 14, wherein said allowable range imposing step imposes a decreased allowable range in accordance with a blunt value of local maximum values and a blunt value of local minimum values of said air-fuel ratio feedback control parameter when all of the feedback control conditions by said downstream-side air-fuel ratio sensor are satisfied.

19. A method as set forth in claim 12, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

20. A method as set forth in claim 12, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

21. A method as set forth in claim 12, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

22. A method as set forth in claim 12, wherein said air-fuel ratio feedback control parameter is determined by a reference voltage with which the output of said upstream-side air-fuel ratio sensor is compared, thereby determining whether the air-fuel ratio is on the rich side or on the lean side.

23. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a a specific component in the exhaust gas, comprising the steps of:

determining whether or not all air-fuel ratio feedback control conditions for said downstream-side air-fuel ratio sensor are satisfied;

calculating an air-fuel ratio correction amount in accordance with the outputs of said upstream-side and downstream-side air-fuel ratio sensors when all of said air-fuel ratio feedback control conditions are satisfied;

lowering a speed of renewal of said air-fuel ratio correction amount in accordance with the output of said downstream-side air-fuel sensor for a predetermined time period commencing when all of the air-fuel ratio feedback control conditions for said downstream-side air-fuel ratio sensor are satisfied; and adjusting an actual air-fuel ratio in accordance with said air-fuel ratio correction amount.

24. A method as set forth in claim 23, wherein said air-fuel ratio correction amount calculating step comprises the steps of:

calculating a first air-fuel ratio correction amount in accordance with the output of said upstream-side air-fuel ratio sensor; and calculating a second air-fuel ratio correction amount in accordance with the output of said downstream-side air-fuel ratio sensor, said air-fuel ratio correction amount calculating step calculating said air-fuel ratio correction amount in accordance with said first and second air-fuel ratio correction amounts.

25. A method as set forth in claim 24, wherein, when at least one of the feedback control conditions for said downstream-side air-fuel ratio sensor is not satisfied, said second air-fuel ratio correction amount is a value of said second air-fuel ratio correction amount immediately before at least one of the air-fuel ratio feedback control conditions for said downstream-side air-fuel ratio sensor is not satisfied.

26. A method as set forth in claim 24, wherein said second air-fuel ratio correction amount calculating step comprises the steps of:

remarkably increasing said second air-fuel ratio correction amount by a rich skip amount when the output of said downstream-side air-fuel ratio sensor is switched from the rich side to the lean side; and remarkably decreasing said second air-fuel ratio correction amount by a lean skip amount when the output of said downstream-side air-fuel ratio sensor is switched from the lean side to the rich side, said renewal speed lowering step reducing said rich and lean skip amounts.

27. A method as set forth in claim 24, wherein said second air-fuel ratio correction amount calculating step comprises the steps of:

gradually increasing said second air-fuel ratio correction amount by a rich integration amount when the output of said downstream-side air-fuel ratio sensor indicates a lean state; and gradually decreasing said air-fuel ratio correction amount by a lean integration amount when the output of said downstream-side air-fuel ratio sensor indicates a rich state, said renewal speed lowering step reducing said rich and lean integration amounts.

28. A method as set forth in claim 23, wherein said air-fuel ratio correction amount calculating step comprises the steps of:

calculating an air-fuel ratio feedback control parameter in accordance with the output of said downstream-side air-fuel ratio sensor; and calculating said air-fuel ratio correction amount in accordance with the output of said upstream-side air-fuel ratio sensor and said air-fuel ratio feedback control parameter.

29. A method as set forth in claim 28, wherein, when at least one of the feedback control conditions for said downstream-side air-fuel ratio sensor is not satisfied, said air-fuel ratio feedback control parameter is a value of said air-fuel ratio feedback control parameter immediately before at least one of the air-fuel ratio feedback control conditions for said downstream-side air-fuel ratio sensor is not satisfied.

30. A method as set forth in claim 28, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

31. A method as set forth in claim 28, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

32. A method as set forth in claim 28, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

33. A method as set forth in claim 28, wherein said air-fuel ratio feedback control parameter is determined by a reference voltage with which the output of said upstream-side air-fuel ratio sensor is compared, thereby determining whether the air-fuel ratio is on the rich side or on the lean side.

34. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for determining whether or not all air-fuel ratio feedback control conditions for said downstream-side air-fuel ratio sensor are satisfied;

means for calculating an air-fuel ratio correction amount in accordance with the outputs of said upstream-side and downstream-side air-fuel ratio sensors when all of said air-fuel ratio feedback control conditions are satisfied;

means for determining whether or not the output of said downstream-side air-fuel ratio sensor is reversed;

means for lowering a speed of renewal of said air-fuel ratio correction amount in accordance with the output of said downstream-side air-fuel ratio sensor after all of the air-fuel ratio feedback control conditions for said downstream-side air-fuel ratio sensor are satisfied and until the output of said downstream-side air-fuel ratio sensor is reversed; and means for adjusting an actual air-fuel ratio in accordance with said air-fuel ratio correction amount.

35. An apparatus as set forth in claim 34, wherein said renewal speed lowering means lowers said renewal speed only when the output of said downstream-side air-fuel ratio sensor indicates a lean state.

36. An apparatus as set forth in claim 34, wherein said air-fuel ratio correction amount calculating step comprises:

means for calculating a first air-fuel ratio correction amount in accordance with the output of said upstream-side air-fuel ratio sensor; and means for calculating a second air-fuel ratio correction amount in accordance with the output of said downstream-side air-fuel ratio sensor, said air-fuel ratio correction amount calculating means calculating said air-fuel ratio correction amount in accordance with said first and second air-fuel ratio correction amounts.

37. An apparatus as set forth in claim 36, wherein, when at least one of the feedback control conditions for said downstream-side air-fuel ratio sensor is not satisfied, said second air-fuel ratio correction amount is a value of said second air-fuel ratio correction amount immediately before at least one of the air-fuel ratio feedback control conditions for said downstream-side air-fuel ratio sensor is not satisfied.

38. An apparatus as set forth in claim 36, wherein said second air-fuel ratio correction amount calculating means comprises:

means for remarkably increasing said second air-fuel ratio correction amount by a rich skip amount when the output of said downstream-side air-fuel ratio sensor is switched from the rich side to the lean side; and means for remarkably decreasing said second air-fuel ratio correction amount by a lean skip amount when the output of said downstream-side air-fuel ratio sensor is switched from the lean side to the rich side, said renewal speed lowering means reducing said rich and lean skip amounts.

39. An apparatus as set forth in claim 36, wherein said second air-fuel ratio correction amount calculating means comprises:

means for gradually increasing said second air-fuel ratio correction amount by a rich integration amount when the output of said downstream-side air-fuel ratio sensor indicates a lean state; and means for gradually decreasing said air-fuel ratio correction amount by a lean integration amount when the output of said downstream-side air-fuel ratio sensor indicates a rich state, said renewal speed lowering means reducing said rich and lean integration amounts.

40. An apparatus as set forth in claim 36, further comprising:

means for lowering a renewal speed of said second air-fuel ratio correction amount after all of the air-fuel ratio feedback control conditions for said downstream-side air-fuel ratio sensor are satisfied and until the output of said downstream-side air-fuel ratio sensor is reversed; and means for imposing an allowable range on said second air-fuel ratio correction amount.

41. An apparatus as set forth in claim 40, wherein said allowable range imposing means imposes said second air-fuel ratio correction amount only when the output of said downstream-side air-fuel ratio sensor indicates a lean state.

42. An apparatus as set forth in claim 40, wherein said allowable range imposing means imposes a decreased allowable range in accordance with said second air-fuel ratio correction amount immediately before all of the feedback control conditions for said downstream-side air-fuel ratio sensor are satisfied.

43. An apparatus as, set forth in claim 40, wherein said allowable range imposing means imposes a decreased allowable range in accordance with a maximum value and a minimum value of said second air-fuel ratio correction amount when all of the feedback control conditions for said downstream-side air-fuel ratio sensor are satisfied.

44. An apparatus as set forth in claim 40, wherein said allowable range imposing means imposes a decreased allowable range in accordance with a blunt value of local maximum values and a blunt value of local minimum values of said second air-fuel ratio correction amount when all of the feedback control conditions for said downstream-side air-fuel ratio sensor are satisfied.

45. An apparatus as set forth in claim 34, wherein said air-fuel ratio correction amount calculating step comprises:

means for calculating an air-fuel ratio feedback control parameter in accordance with the output of said downstream-side air-fuel ratio sensor; and means for calculating said air-fuel ratio correction amount in accordance with the output of said upstream-side air-fuel ratio sensor and said air-fuel ratio feedback control parameter.

46. An apparatus as set forth in claim 45, wherein, when at least one of the feedback control conditions for said downstream-side air-fuel ratio sensor is not satisfied, said air-fuel ratio feedback control parameter is a value of said air-fuel ratio feedback control parameter immediately before at least one of the air-fuel ratio feedback control conditions for said downstream-side air-fuel ratio sensor is not satisfied.

47. An apparatus as set forth in claim 45, further comprising:

means for lowering a renewal speed of said air-fuel ratio feedback control parameter after all of the air-fuel ratio feedback control conditions for said downstream-side air-fuel ratio sensor are satisfied and until the output of said downstream-side air-fuel ratio sensor is reversed; and means for imposing an allowable range on said air-fuel ratio feedback control parameter.

48. An apparatus as set forth in claim 47, wherein said allowable range imposing means imposes said air-fuel ratio feedback control parameter only when the output of said downstream-side air-fuel ratio sensor indicates a lean state.

49. An apparatus as set forth in claim 47, wherein said allowable range imposing means imposes a decreased allowable range in accordance with said air-fuel ratio feedback control parameter amount immediately before all the feedback control conditions for said downstream-side air-fuel ratio sensor are satisfied.

50. An apparatus as set forth in claim 47, wherein said allowable imposing means imposes a decreased allowable range in accordance with a maximum value and a minimum value of said air-fuel ratio feedback control parameter when all of the feedback control conditions by said downstream-side air-fuel ratio sensor are satisfied.

51. An apparatus as set forth in claim 47, wherein said allowable range imposing means imposes a decreased allowable range in accordance with a blunt value of local maximum values and a blunt value of local minimum values of said air-fuel ratio feedback control parameter when all of the feedback control conditions by said downstream-side air-fuel ratio sensor are satisfied.

52. An apparatus as set forth in claim 45, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of aid downstream-side air-fuel ratio sensor is switched from the rich side to the lean side.

53. An apparatus as set forth in claim 45, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

54. An apparatus as set forth in claim 45, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

55. An apparatus as set forth in claim 45, wherein said air-fuel ratio feedback control parameter is determined by a reference voltage with which the output of said upstream-side air-fuel ratio sensor is compared, thereby determining whether the air-fuel ratio is on the rich side or on the lean side.

56. An apparatus for controlling an air-fuel ratio in an internal combustion engine having ca catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for determining whether or not all air-fuel ratio feedback control conditions for said downstream-side air-fuel ratio sensor are satisfied;

means for calculating an air-fuel ratio correction amount in accordance with the outputs of said upstream-side and downstream-side air-fuel ratio sensors when all of said air-fuel ratio feedback control conditions are satisfied;

means for lowering a speed of renewal of said air-fuel ratio correction amount in accordance with the output of said downstream-side air-fuel ratio sensor for a predetermined time period commencing when all of the air-fuel ratio sensor are satisfied; and mean as for adjusting an actual air-fuel ratio in accordance with said air-fuel ratio correction amount.

57. An apparatus as set forth in claim 56, wherein said air-fuel ratio correction amount calculating means comprises:

means for calculating a first air-fuel ratio correction amount in accordance with the output of said upstream-side air-fuel ratio sensor; and means for calculating a second air-fuel ratio correction amount in accordance with the output of said downstream-side air-fuel ratio sensor, said air-fuel ratio correction amount calculating step calculating said air-fuel ratio correction amount in accordance with said first and second air-fuel ratio correction amounts.

58. An apparatus as set forth in claim 57, wherein, when at least one of the feedback control conditions for said downstream-side air-fuel ratio sensor is not satisfied, said second air-fuel ratio correction amount is a value of said second air-fuel ratio correction amount immediately before at least one of the air-fuel ratio feedback control conditions for said downstream-side air-fuel ratio sensor is not satisfied.

59. An apparatus as set forth in claim 57, wherein said second air-fuel ratio correction amount calculating step comprises:

means for remarkably increasing said second air-fuel ratio correction amount by a rich skip amount when the output of said downstream-side air-fuel ratio sensor is switched from the rich side to the lean side; and means for remarkably decreasing said second air-fuel ratio correction amount by a lean skip amount when the output of said downstream-side air-fuel ratio sensor is switched from the lean side to the rich side, said renewal speed lowering step reducing said rich and lean skip amounts.

60. An apparatus as set forth in claim 57, wherein said second air-fuel ratio correction amount calculating means comprises:

means for gradually increasing said second air-fuel ratio correction amount by a rich integration amount when the output of said downstream-side air-fuel ratio sensor indicates a lean state; and means for gradually decreasing said air-fuel ratio correction amount by a lean integration amount when the output of said downstream-side air-fuel ratio sensor indicates a rich state, said renewal speed lowering step reducing said rich and lean integration amounts.

61. An apparatus as set forth in claim 56, wherein said air-fuel ratio correction amount calculating means comprises the steps of:

means for calculating an air-fuel ratio feedback control parameter in accordance with the output of said downstream-side air-fuel ratio sensor; and means for calculating said air-fuel ratio correction amount in accordance with the output of said upstream-side air-fuel ratio sensor and said air-fuel ratio feedback control parameter.

62. An apparatus as set forth in claim 61, wherein, when at least one of the feedback control conditions for said downstream-side air-fuel ratio sensor is not satisfied, said air-fuel ratio feedback control parameter is a value of said air-fuel ratio feedback control parameter immediately before at least one of the air-fuel ratio feedback control conditions for said downstream-side air-fuel ratio sensor is not satisfied.

63. An apparatus as set forth in claim 61, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

64. An apparatus as set forth in claim 61, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

65. An apparatus as set forth in claim 61, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

66. An apparatus as set forth in claim 61, wherein said air-fuel ratio feedback control parameter is determined by a reference voltage with which the output of said upstream-side air-fuel ratio sensor is compared, thereby determining whether the air-fuel ratio is on the rich side or on the lean side.

67. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

determining whether or not all air-fuel ratio feedback control conditions for said downstream-side air-fuel ratio sensor are satisfied:

calculating a first air-fuel ratio correction amount in accordance with the output of said upstream-side air-fuel ratio sensor;

calculating a second air-fuel ratio correction amount in accordance with the output of said downstream-side air-fuel ratio sensor;

calculating an air-fuel ratio correction amount in accordance with said first and second air-fuel ratio correction amounts;

lowering a speed of renewal of said air-fuel ratio correction amount in accordance with the output of said downstream-side air-fuel ratio sensor for a time period commencing when all of the air-fuel ratio feedback control conditions for said downstream-side air-fuel ratio sensor are satisfied;

imposing an allowable range on said second air-fuel ratio correction amount; and adjusting an actual air-fuel ratio in accordance with said air-fuel ratio correction amount.

68. The method of claim 67 further comprising the step of determining whether the output of the downstream-side air-fuel ratio sensor is reversed, and wherein the step of imposing an allowable range includes imposing an allowable range after all of the air-fuel ratio feedback control conditions for said downstream-side air-fuel ratio sensor are satisfied and until the output of the downstream-side air-fuel ratio sensor is reversed.

69. The method of claim 67, further comprising the step of determining whether the output of the downstream-side air-fuel ratio sensor is reversed, and wherein the step of imposing an allowable range includes imposing a first allowable range after all of the air-fuel ratio feedback control conditions for said downstream-side air-fuel ratio sensor are satisfied and until the output of the downstream-side air-fuel ratio sensor is reversed, and imposing a second allowable range after the output of the downstream-side air-fuel ratio sensor is reversed.

70. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

determining whether or not all air-fuel ratio feedback control conditions for said downstream-side air-fuel ratio sensor are satisfied;

calculating a first air-fuel ratio correction amount in accordance with the output of said upstream-side air-fuel ratio sensor;

calculating a second air-fuel ratio correction amount in accordance with the output of said downstream-side air-fuel ratio sensor;

calculating an air-fuel ratio correction amount in accordance with said first and second air-fuel ratio correction amounts;

lowering a speed of renewal of said air-fuel ratio correction amount in accordance with the output of said downstream-side air-fuel ratio sensor for a time period commencing when all of the air-fuel ratio feedback control conditions for said downstream-side air-fuel ratio sensor are satisfied by imposing an allowable range ons aid second air-fuel ratio correction amount;

adjusting an actual air-fuel ratio in accordance with said air-fuel ratio correction amount; and wherein the step of imposing an allowable range includes imposing a first allowable range for the time period after all of the air-fuel ratio feedback control conditions for said downstream-side air-fuel ratio sensor are satisfied, and imposing a second allowable range upon expiration of the time period.

71. A method as set forth in claim 70, wherein, when at least one of the feedback control conditions for said downstream-side air fuel ratio sensor is not satisfied, said second air-fuel ratio correction amount is a value of said second air-fuel ratio correction amount immediately before at least one of the air-fuel ratio feedback control conditions for said downstream-side air-fuel ratio sensor is not satisfied.

72. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

determining whether or not all air-fuel ratio feedback control conditions for said downstream-side air-fuel ratio sensor are satisfied;

calculating an air-fuel ratio feedback control parameter in accordance with the output of said downstream-side air-fuel ratio sensor;

lowering a speed of renewal of said air-fuel ratio correction amount in accordance with the output of said downstream-side air-fuel ratio sensor for a time period commencing when all of the air-fuel ratio feedback control conditions for said downstream-side air-fuel ratio sensor are satisfied;

imposing an allowable range on said second air-fuel ratio feedback control parameter; and adjusting an actual air-fuel ratio in accordance with said air-fuel ratio correction amount.

73. The method of claim 72, further comprising the step of determining whether the output of the downstream-side air-fuel ratio sensor is reversed, and wherein the step of imposing an allowable range includes imposing an allowable range after all of the air-fuel ratio feedback control conditions for said downstream-side air-fuel ratio sensor are satisfied and until the output of the downstream-side air-fuel ratio sensor is reversed.

74. The method of claim 72, further comprising the step of determining whether the output of the downstream-side air-fuel ratio sensor is reversed, and wherein the step of imposing an allowable range includes imposing a first allowable range after all of the air-fuel ratio feedback control conditions for said downstream-side air-fuel ratio sensor are satisfied and until the output of the downstream-side air-fuel ratio sensor is reversed, and imposing a second allowable range after the output of the downstream-side air-fuel ratio sensor is reversed.

75. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

determining whether or not all of air-fuel ratio feedback control conditions for said downstream-side air-fuel ratio sensor are satisfied;

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

lowering a speed of renewal of said air-fuel ratio correction amount in accordance with the output of said downstream-side air-fuel ratio sensor for a time period commencing when all of the air-fuel ratio feedback control conditions for said downstream-side air-fuel ratio sensor are satisfied by imposing an allowable range on said air-fuel ratio feedback control parameter;

adjusting an actual air-fuel ratio in accordance with said air-fuel ratio correction amount; and wherein the step of imposing an allowable range includes imposing a first allowable range for the time period after all of the air-fuel ratio feedback control conditions for said downstream-side air-fuel ratio sensor are satisfied, and imposing a second allowable range upon expiration of the time period.

76. A method as set forth in claim 75, wherein, when at least one of the feedback control conditions for said downstream-side air fuel ratio sensor is not satisfied, said air-fuel ratio feedback control parameter is a value of said air-fuel ratio feedback control parameter immediately before at least one of the air-fuel ratio feedback control conditions for said downstream-side air-fuel ratio sensor is not satisfied.

77. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for determining whether or not all air-fuel ratio feedback control conditions for said downstream-side air-fuel ratio sensor are satisfied;

means for calculating a first air-fuel ratio correction amount in accordance with the output of said upstream-side air-fuel ratio sensor;

means for calculating a second air-fuel ratio correction amount in accordance with the output of said downstream-side air-fuel ratio sensor;

means for calculating an air-fuel ratio correction amount in accordance with said first and second air-fuel ratio correction amounts;

means for lowering a speed of renewal of said air-fuel ratio correction amount in accordance with the output of said downstream-side air-fuel ratio sensor for a time period commencing when all of the air-fuel ratio feedback control conditions for said downstream-side air-fuel ratio sensor are satisfied;

means for imposing an allowable range on said second air-fuel ratio correction amount; and means for adjusting an actual air-fuel ratio in accordance with said air-fuel ratio correction amount.

78. The apparatus of claim 77, further comprising means for determining whether the output of the downstream-side air-fuel ratio sensor is reversed, and wherein the means for imposing an allowable range includes means for imposing an allowable range after all of the air-fuel ratio feedback control conditions for said downstream-side air-fuel ratio sensor are satisfied and until the output of the downstream-side air-fuel ratio sensor is reversed.

79. The apparatus of claim 77, further comprising means for determining whether the output of the downstream-side air-fuel ratio sensor is reversed, and wherein the means for imposing an allowable range includes means for imposing a first allowable range after all of the air-fuel ratio feedback control conditions for said downstream-side air-fuel ratio sensor are satisfied and until the output of the downstream-side air-fuel ratio sensor is reversed, and imposing a second allowable range after the output of the downstream-side air-fuel ratio sensor is reversed.

80. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for determining whether or not all air-fuel ratio feedback control conditions for said downstream-side air-fuel ratio sensor are satisfied;

means for calculating a first air-fuel ratio correction amount in accordance with the output of said upstream-side air-fuel ratio sensor;

means for calculating a second air-fuel ratio correction amount in accordance with the output of said downstream-side air-fuel ratio sensor;

means for calculating an air-fuel ratio correction amount in accordance with said first and second air-fuel ratio correction amounts;

means for lower speed of renewal of said air-fuel ratio correction amount in accordance with the output of said downstream-side-fuel ratio sensor for a time period commencing when all of the air-fuel ratio feedback control conditions for said downstream-side air-fuel ratio sensor are satisfied by imposing an allowable range on said second air-fuel ratio correction amount;

means for adjusting an actual air-fuel ratio in accordance with said air-fuel ratio correction amount; and wherein the means for imposing an allowable range includes means for imposing a first allowable range for the time period after all of the air-fuel ratio feedback control conditions for said downstream-side air-fuel ratio sensor are satisfied, and means for imposing a second allowable range upon expiration of the time period.

81. An apparatus as set forth in claim 80, wherein, when at least one of the feedback control conditions for said downstream-side air-fuel ratio sensor is not satisfied, said second air-fuel ratio correction amount is a value of said second air-fuel ratio correction amount immediately before at least one of the air-fuel ratio feedback control conditions for said downstream-side air-fuel ratio sensor is not satisfied.

82. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for determining whether or not all air-fuel ratio feedback control conditions from said downstream-side air-fuel ratio sensor are satisfied;

means for calculating an air-fuel ratio feedback control parameter in accordance with the output of said downstream-side air-fuel ratio sensor;

means for calculating an air-fuel ratio correction amount in accordance with the output of said upstream-side air-fuel ratio sensor and said air-fuel ratio feedback control parameter;

means for lowering a speed of renewal of said air-fuel ratio correction amount in accordance with the output of said downstream-side air-fuel ratio sensor for a time period commencing when all of the air-fuel ratio feedback control conditions for said downstream-side air-fuel ratio sensor are satisfied;

means for imposing an allowable range on said second air-fuel ratio feedback control parameter; and means for adjusting an actual air-fuel ratio in accordance with said air-fuel ratio correction amount.

83. The apparatus of claim 82 further comprising means for determining whether the output of the downstream-side air-fuel ratio sensor is reversed, and wherein the means for imposing an allowable range includes means for imposing and allowable range after all of the air-fuel ratio feedback control conditions for said downstream-side air-fuel ratio sensor are satisfied and until the output of the downstream-side air-fuel ratio sensor is reversed.

84. The apparatus of claim 82, further comprising the means for determining whether the output of the downstream-side air-fuel ratio sensor is reversed, and wherein the means for imposing an allowable range includes means for imposing a first allowable range after all of the air-fuel ratio feedback control conditions for said downstream-side air-fuel ratio sensor are satisfied and until the output of the downstream-side air-fuel ratio sensor is reversed, and imposing a second allowable range after the output of the downstream-side air-fuel ratio sensor is reversed.

85. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting a concentration of a specific component in the exhaust gas, comprising:

means for determining whether or not all air-fuel ratio feedback control conditions for said downstream-side air-fuel ratio sensor are satisfied;

means for calculating an air-fuel ratio feedback control parameter in accordance with the output of said downstream-side air-fuel ratio sensor;

means for calculating an air-fuel ratio correction amount in accordance with the output of said downstream-side air-fuel ratio sensor;

means for calculating an air-fuel ratio correction amount in accordance with the output of said upstream-side air-fuel ratio sensor and said air-fuel ratio feedback control parameter;

means for lowering a speed of renewal of said air-fuel ratio correction amount in accordance with the output of said downstream-side air-fuel ratio sensor for a time period commencing when all of the air-fuel ratio feedback control conditions for said downstream-side air-fuel ratio sensor for a time period commencing when all of the air-fuel ratio feedback control conditions for said downstream-side air-fuel ratio sensor are satisfied by imposing an allowable range on said air-fuel ratio feedback control parameter;

means for adjusting an actual air-fuel ratio in accordance with said air-fuel ratio correction amount; and wherein the means for imposing an allowable range includes means for imposing a first allowable range for the time period after all of the air-fuel ratio feedback control conditions for said downstream-side air-fuel ratio sensor are satisfied, and means for imposing a second allowable range upon expiration of the time period.

86. An apparatus as set forth in claim 85, wherein, when at least one of the feedback control conditions for said downstream-side air fuel ratio sensor is not satisfied, said air-fuel ratio feedback control parameters is a value of said air-fuel ratio feedback control parameter immediately before at least one of the air-fuel ratio feedback control conditions for said downstream-side air-fuel ratio sensor is not satisfied.

* * * * *